US009195195B2

(12) United States Patent
Kanamoto

(10) Patent No.: US 9,195,195 B2
(45) Date of Patent: Nov. 24, 2015

(54) CONTROL APPARATUS AND STORAGE MEDIUM FOR STORING AND EXECUTING A PRINT JOB

(71) Applicant: CANON KABUSHIKI KAISHA, Tokyo (JP)

(72) Inventor: Yoshiji Kanamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/299,913

(22) Filed: Jun. 9, 2014

(65) Prior Publication Data

US 2014/0363187 A1 Dec. 11, 2014

(30) Foreign Application Priority Data

Jun. 11, 2013 (JP) ..... 2013-122459

(51) Int. Cl.
*G03G 15/00* (2006.01)

(52) U.S. Cl.
CPC ..... *G03G 15/6508* (2013.01); *G03G 15/502* (2013.01); *G03G 15/5016* (2013.01)

(58) Field of Classification Search
CPC ..... G03G 15/502; G03G 15/5029; G03G 15/5095; G03G 15/6508; G03G 15/5016; G03G 2215/00447; G03G 2215/00725
See application file for complete search history.

(56) References Cited

U.S. PATENT DOCUMENTS

| | | | | |
|---|---|---|---|---|
| 2012/0002223 | A1* | 1/2012 | Tanaka | 358/1.9 |
| 2014/0168671 | A1* | 6/2014 | Kanamoto et al. | 358/1.9 |
| 2015/0029558 | A1* | 1/2015 | Koike | 358/3.24 |

FOREIGN PATENT DOCUMENTS

| | | | |
|---|---|---|---|
| JP | 2010-049167 | A | 3/2010 |
| JP | 2010-284919 | A | 12/2010 |

* cited by examiner

*Primary Examiner* — Ryan Walsh
(74) *Attorney, Agent, or Firm* — Canon USA, Inc., IP Division

(57) ABSTRACT

In a case where it is determined that attribute information of a first sheet is not stored in a storing unit and it is determined that no sheets are held in a sheet holding unit with respect to which attribute information of a second sheet is stored in the storing unit, a control apparatus performs a notification indicating that the attribute information of the first sheet is not stored in the storing unit and no sheets are held in the sheet holding unit with respect to which the attribute information of the second sheet is stored in the storing unit.

13 Claims, 24 Drawing Sheets

FIG.8

| | 811 SHEET HOLDING UNIT ID | 812 SIZE | 813 MEDIA TYPE | 814 REMAINING AMOUNT |
|---|---|---|---|---|
| 801 | 1 | A4 | PLAIN PAPER 1 | 3 |
| 802 | 2 | A4 | COLORED PAPER (RED) | 1 |
| 803 | 3 | A3 | PLAIN PAPER 1 | 2 |
| 804 | 4 | B4 | PLAIN PAPER 1 | 0 |
| 805 | 5 | B5 | PLAIN PAPER 1 | 3 |
| 806 | 6 | A4 | INDEX PAPER | 3 |
| 807 | 7 | LTR | PLAIN PAPER 1 | 1 |
| 808 | 8 | A4 | DOUBLE-SIDED COATED PAPER 1 | 1 |
| 809 | 9 | 11×17 | PLAIN PAPER 1 | 0 |
| 810 | 10 | A3 | THICK PAPER 2 | 0 |

FIG.9A

Job A

| | SIZE | MEDIA TYPE |
|---|---|---|
| 901 | | |
| 904 | A4 | PLAIN PAPER 1 |
| 905 | A4 | DOUBLE-SIDED COATED PAPER 1 |

FIG.9B

Job D

| | SIZE | MEDIA TYPE |
|---|---|---|
| 902 | | |
| 906 | LTR | PLAIN PAPER 1 |
| 907 | 11×17 | PLAIN PAPER 1 |

FIG.9C

Job E

| | SIZE | MEDIA TYPE |
|---|---|---|
| 903 | | |
| 908 | A4 | PLAIN PAPER 1 |
| 909 | A4 | COLORED PAPER (RED) |
| 910 | A3 | DOUBLE-SIDED COATED PAPER 2 |

FIG.12

| | 811 SHEET HOLDING UNIT ID | 812 SIZE | 813 MEDIA TYPE | 814 REMAINING AMOUNT | |
|---|---|---|---|---|---|
| 801 | 1 | A4 | PLAIN PALER 1 | 3 | |
| 802 | 2 | A4 | COLORED PAPER (RED) | 1 | |
| 803 | 3 | A3 | PLAIN PALER 1 | 2 | |
| 804 | 4 | A3 | DOUBLE-SIDED COATED PAPER 2 | 3 | 1202 |
| 805 | 5 | B5 | PLAIN PALER 1 | 3 | |
| 806 | 6 | A4 | INDEX PAPER | 3 | |
| 807 | 7 | LTR | PLAIN PALER 1 | 1 | |
| 808 | 8 | A4 | DOUBLE-SIDED COATED PAPER 1 | 1 | |
| 809 | 9 | 11×17 | PLAIN PALER 1 | 3 | 1201 |
| 810 | 10 | A3 | THICK PAPER 2 | 0 | |

CONTROL APPARATUS AND STORAGE MEDIUM FOR STORING AND EXECUTING A PRINT JOB

BACKGROUND OF THE INVENTION

1. Field of the Invention

The present invention relates to a control apparatus capable of storing a job and executing the stored job and to a computer-readable storage medium storing a computer program for controlling the control apparatus.

2. Description of the Related Art

There is a conventionally known technique to notify a user of attribute information of a sheet to be used for a job (for example, sheet size) being not registered with any sheet holding unit, on an operation screen of a printing apparatus equipped with a plurality of sheet holding units, as discussed in Japanese Patent Application Laid-Open No. 2010-284919.

There is also a conventionally known technique to notify a user of any one of the size of a sheet to be used for a job being not registered with any sheet holding unit and there being no remaining amount of a sheet to be used for a job, on a screen on which the statuses of jobs are listed, as discussed in Japanese Patent Application Laid-Open No. 2010-49167.

However, in a case where attribute information of a sheet to be used for a job is not registered with any sheet holding unit and there being no remaining amount of a sheet to be used for the job, the user cannot become aware of both the facts. For example, a case is supposed where A3 thick paper is not registered with any sheet holding unit in a job using A3 thick paper and A4 plain paper and there is no remaining amount of A4 plain paper although A4 plain paper is registered with a sheet holding unit. In this case, the user becomes aware of only one of attribute information of a sheet to be used for the job being not registered with any sheet holding unit and there being no remaining amount of a sheet to be used for the job.

SUMMARY OF THE INVENTION

According to an aspect of the present invention, a control apparatus includes a display unit configured to display a job that uses a first sheet and a second sheet, according to a display instruction, a storing unit configured to store attribute information of sheets to be held in sheet holding units, a first determination unit configured to determine, in response to the display instruction, whether attribute information of the first sheet is stored in the storing unit and whether attribute information of the second sheet is stored in the storing unit, a second determination unit configured to determine, in response to the display instruction, whether a sheet is held in a sheet holding unit with respect to which the attribute information of the first sheet is stored in the storing unit and whether a sheet is held in the sheet holding unit with respect to which the attribute information of the second sheet is stored in the storing unit, and a notification unit configured to perform, in a case where the first determination unit determines that the attribute information of the first sheet is not stored in the storing unit and the second determination unit determines that no sheets are held in the sheet holding unit with respect to which the attribute information of the second sheet is stored in the storing unit, a notification indicating that the attribute information of the first sheet is not stored in the storing unit and no sheets are held in the sheet holding unit with respect to which the attribute information of the second sheet is stored in the storing unit, in response to the display instruction.

Further features of the present invention will become apparent from the following description of exemplary embodiments with reference to the attached drawings.

BRIEF DESCRIPTION OF THE DRAWINGS

FIG. 8 illustrates an example of a sheet management table used to manage information about sheets that are held in the respective sheet holding units in the digital printing machine according to the first exemplary embodiment.

FIGS. 9A, 9B, and 9C illustrate sheet information that is used for a job A, a job D, and a job E, respectively, illustrated in FIG. 7.

FIG. 12 illustrates an example of a sheet management table used to manage information about sheets that are held in the respective sheet holding units in the digital printing machine according to the first exemplary embodiment.

DESCRIPTION OF THE EMBODIMENTS

Various exemplary embodiments, features, and aspects of the invention will be described in detail below with reference to the drawings. The following exemplary embodiments are not construed to limit the scope of the present invention. Also, solution methods of the present invention do not need to require all of the combinations of features and aspects described in the following exemplary embodiments.

Figure 1:
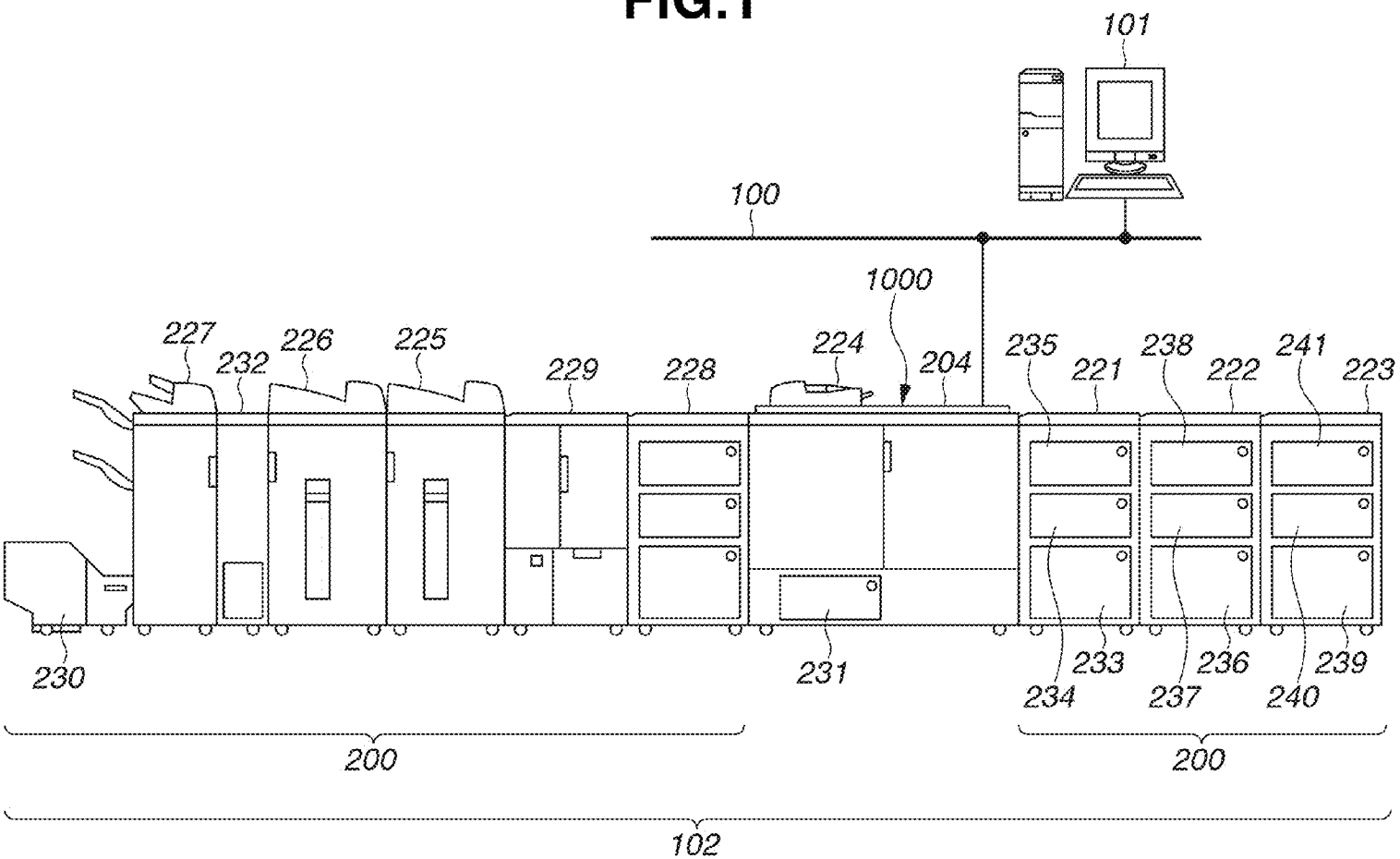
FIG. 1 illustrates a digital printing system according to a first exemplary embodiment of the present invention.

FIG. 1 illustrates a digital printing system according to a first exemplary embodiment of the present invention. The digital printing system includes a digital printing machine (a printing apparatus) 102 and a computer 101, which are interconnected via a network 100.

The digital printing machine 102 includes a plurality of apparatuses, which have respective different functions and are interconnected, and is thus configured to be able to perform complex sheet processing. The respective units constituting the digital printing machine 102 are described below.

A printer unit 1000 forms, based on image data, an image (performs printing) using toner on media (sheet) fed from a sheet holding unit. A configuration and an operating principle of the printer unit 1000 are described below.

The printer unit 1000 irradiates a photosensitive drum with scanning light, which is light beams, such as laser beams, modulated based on image data and reflected by a rotary polygon mirror. The printer unit 1000 develops an electrostatic latent image, formed on the photosensitive drum with the laser beams, with toner into a toner image, and transfers the toner image onto a sheet put on the photosensitive drum. The printer unit 1000 sequentially performs a series of such image forming processes with yellow (Y), magenta (M), cyan (C), and black (K) toners to form a full-color image on the sheet. The printer unit 1000 may be arranged to use not only such four color toners but also spot color toners or transparent toner. The printer unit 1000 then conveys the sheet with a full-color image, put on the photosensitive drum, to a fixing device. The fixing device includes a roller, a belt, and a heat source, such as a halogen heater, contained in the roller. The fixing device fuses and fixes, with heat and pressure, toner on the sheet with the toner image transferred thereon.

The printer unit 1000 of the digital printing machine 102 according to the first exemplary embodiment is equipped with a scanner 224 and an operation unit 204 (FIG. 4), which is mounted on the top surface of the printer unit 1000. The details of the operation unit 204 are not illustrated in FIG. 1, because the operation unit 204 is mounted on the top surface of the printer unit 1000. The operation unit 204 provides various interfaces allowing the user to perform various settings and operations on the printer unit 1000 according to the first exemplary embodiment.

The digital printing machine 102 is configured to allow various optional apparatuses to be attached thereto in addition to the printer unit 1000.

Large-capacity sheet holding apparatuses 221, 222, and 223 are attachable to and detachable from the printer unit 1000. The large-capacity sheet holding apparatuses 221, 222, and 223 respectively include a plurality of sheet holding units 233 to 235, a plurality of sheet holding units 236 to 238, and a plurality of sheet holding units 239 to 241. The sheet holding units 233 to 241 are each equipped with a sensor for detecting the remaining amount of sheets held in each sheet holding unit. With such a configuration, the printer unit 1000 is able to perform print processing with a large volume of sheets.

Large-capacity stackers 225 and 226 are used to stack printed sheets. A system including large-capacity sheet holding apparatuses as described above can produce a large volume of printed products, thus, requiring such a large-capacity stacker. The number of large-capacity stackers or large-capacity sheet holding apparatuses is not limited to that illustrated in FIG. 1.

Each of the large-capacity stackers 225 and 226 is equipped with an external cover, which can be opened in response to a user's instruction operation to allow extraction of sheets stacked on an internal stacking tray. The external cover can also be automatically opened according to an instruction from the printer unit 1000. When an instruction to open the external cover is issued, the large-capacity stackers 225 and 226 are controlled in advance to stop stacking printed sheets.

The large-capacity stackers 225 and 226 each have a shift sheet-discharge function to shift the stacking position of desired sheets during stacking of printed sheets. The shift sheet-discharge function enables sorting a large volume of stacked sheets in units of a predetermined stack. A folding apparatus 232 can perform various folding operations, such as folding in the middle, Z folding, folding in three, and folding in four, on sheets. A saddle-stitch binding machine 227 includes various units configured to perform staple processing, saddle stitching, saddle binding, punch processing, and shift sheet-discharge processing, which are useful for producing a bookbinding product, on the sheets printed by the printer unit 1000. When producing a saddle-stitched output product using the saddle-stitch binding machine 227, the digital printing machine 102 according to the first exemplary embodiment uses a combination of a saddle folding function and a saddle stitching function of the saddle-stitch binding machine 227 without the use of a folding function of the folding apparatus 232.

A cutting apparatus 230 conveys a bound output product saddle-stitched by the saddle-stitch binding machine 227 and cuts portions of the product corresponding to a fore edge to form edges in a planar shape. An inserter 228 inserts a sheet, stored in the inserter 228, between sheets conveyed from the printer unit 1000 at appropriate timing based on the settings. The inserter 228 enables inserting an unprinted sheet between printed sheets. The inserter 228 is equipped with a plurality of large-capacity sheet holding units to deal with a large volume of print processing, like the large-capacity sheet holding apparatuses 221, 222, and 223.

A case binding machine 229 glues a cover sheet to a bundle of sheets printed by the printer unit 1000 or discharged from the inserter 228 to produce a case-bound output product. The case binding machine 229 is also capable of performing top-glue binding processing corresponding to processing for performing glue binding without using a cover sheet.

The digital printing machine 102 can be broadly divided into three regions, including the printer unit 1000, an apparatus group located on the right-hand side of the printer unit 1000, and an apparatus group located on the left-hand side of the printer unit 1000. The apparatus group located on the right-hand side of the printer unit 1000 is called a sheet holding system apparatus, which mainly serially supplies sheets, which are held therein, to the printer unit 1000 at appropriate timing. The apparatus group located on the right-hand side of the printer unit 1000 also detects, with a sensor (not illustrated), the remaining amount of sheets held therein. A sheet holding unit 231 is also mounted inside the printer unit 1000. The sheet holding unit 231 is capable of performing operations functionally similar to those of the sheet holding system apparatus. Such a sheet holding unit included in the printer unit 1000 is also referred to as a sheet supply system apparatus in the following description.

On the other hand, the apparatus group located on the left-hand side of the printer unit 1000 in FIG. 1 is called a sheet treatment apparatus. The sheet treatment apparatus may be called a sheet processing apparatus or a post-processing apparatus. The sheet treatment apparatus applies various treatment processes to sheets subjected to print processing or performs various processes, such as stacking, on the sheets. The above-described sheet holding system apparatus and the sheet treatment apparatus are collectively referred to as a sheet processing apparatus 200 in the following description.

The computer 101 is a general-purpose computer connected to the digital printing machine 102 via the network 100. The computer 101 can execute various application programs and can transmit a print job to the digital printing machine 102.

Figure 2:
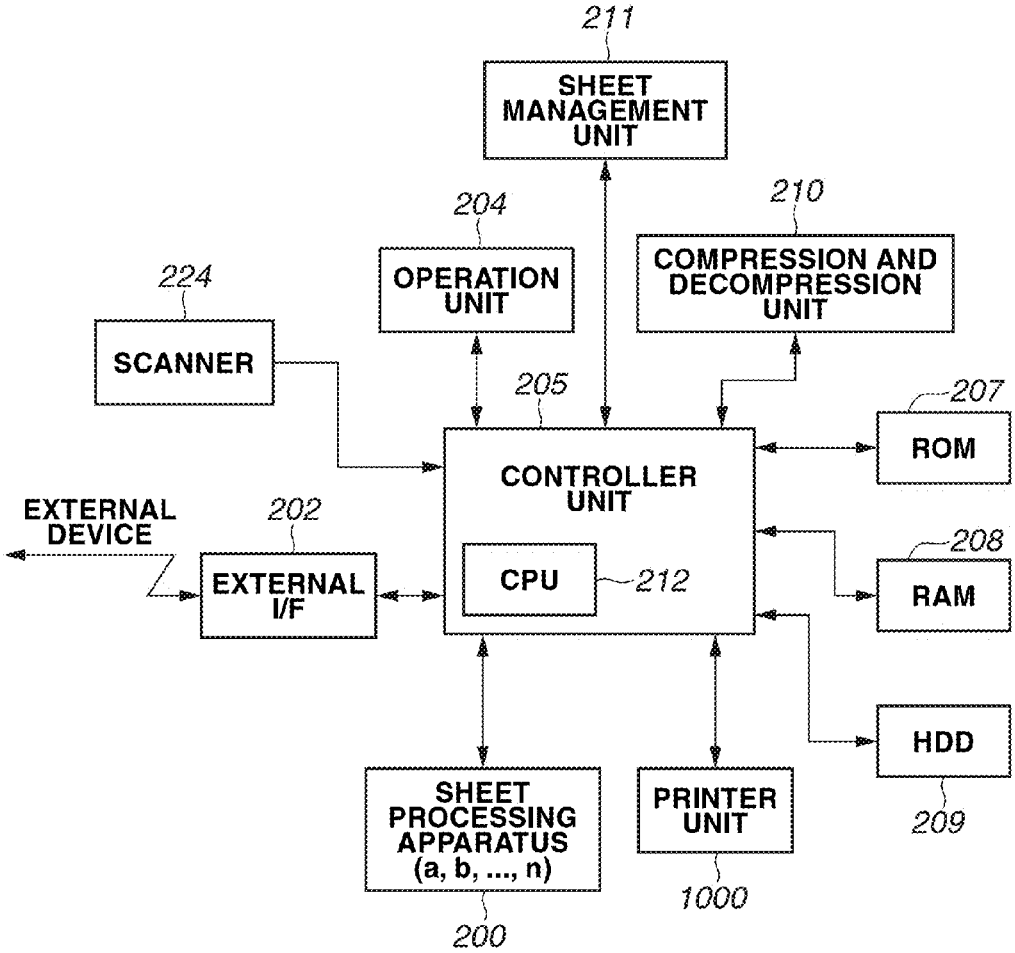
FIG. 2 is a functional block diagram illustrating a functional configuration of a digital printing machine according to the first exemplary embodiment.

FIG. 2 is a functional block diagram illustrating a configuration (mainly, a software configuration) of the digital printing machine 102 according to the first exemplary embodiment.

Blocks illustrated in FIG. 2 are divided in units of system functions. Therefore, some blocks do not exactly correspond to units of hardware configuration illustrated in FIG. 1.

The digital printing machine 102 contains a nonvolatile memory, such as a hard disk (HDD) 209, which is able to store data of a plurality of jobs to be processed. While the digital printing machine 102 according to the present exemplary embodiment uses a hard disk, the digital printing machine 102 may use a similar large-capacity and nonvolatile storage device instead of the hard disk.

The digital printing machine 102 has a copy function to store data received from the scanner 224 into the HDD 209, retrieve the data from the HDD 209, and print the data with the printer unit 1000. Also, the digital printing machine 102 has a printing function to store, into the HDD 209, job data received from an external device via an external interface (I/F) 202, which is an example of a communication unit, retrieve the job data from the HDD 209, and print the job data with the printer unit 1000. Thus, the digital printing machine 102 is a multi-function peripheral (MFP) having such a plurality of functions (also referred to as an image forming apparatus). The digital printing machine 102 may be a color printing machine or a monochrome printing machine.

The scanner 224 reads a document image, performs image processing on image data obtained by reading the document image, and outputs the processed image data. The external I/F 202 transmits and receives image data, etc., to and from a facsimile apparatus, a network-connected apparatus, or an external dedicated apparatus. The HDD 209 stores various types of management information, which are permanently stored, changed, or managed by the digital printing machine 102. The digital printing machine 102 is equipped with the printer unit 1000, which performs print processing on job data to be processed stored in the HDD 209. The digital printing machine 102 is further equipped with an operation unit 204 including a display unit, which corresponds to an example of a user interface unit. A controller unit (a control unit) 205, which corresponds to an example of a control unit, included in the digital printing machine 102 includes a central processing unit (CPU) 212. The controller unit 205 comprehensively controls processes and operations of the various units of the digital printing machine 102. A read-only memory (ROM) 207 stores various control programs required in the first exemplary embodiment, including programs for executing various processing operations illustrated in the flowcharts described below. The ROM 207 further stores a display control program for displaying various user interface (UI) screens on the display unit of the operation unit 204.

The CPU 212 reads out and executes programs stored in the ROM 207 to cause the digital printing machine 102 to perform various operations according to the first exemplary embodiment. Furthermore, the ROM 207 stores a program for causing the CPU 212 to interpret page description language (PDL) data received from the external device via the external I/F 202 and to rasterize the PDL data into raster image data (bitmapped image data). The ROM 207 further stores a program for causing the CPU 212 to interpret a print job received from the external device via the external I/F 202 and to process the print job. These programs are processed by software. The ROM 207 is a read-only storage medium, which previously stores various programs including programs for a boot sequence, font information, etc., and the above-described programs. The details of the various programs stored in the ROM 207 are described below. A random access memory (RAM) 208 is a random-access read/write storage device, which stores image data received from the scanner 224 or the external I/F 202, various programs, and setting information.

Furthermore, the HDD 209 stores image data compressed by a compression and decompression unit 210. The HDD 209 is configured to be able to store a plurality of pieces of data, including print data of jobs to be processed. The controller unit 205 stores, into the HDD 209, data of jobs to be processed input via the various input units, such as the scanner 224 and the external I/F 202, retrieves the job data from the HDD 209, and outputs the job data to the printer unit 209 to perform printing. The controller unit 205 further performs control to transmit, to the external device, job data retrieved from the HDD 209. Thus, the controller unit 205 performs various output processing operations on data of jobs to be processed stored in the HDD 209. The compression and decompression unit 210 compresses and decompresses image data stored in the RAM 208 or the HDD 209 according to various compression methods, such as the Joint Bi-level Image Experts Group (JBIG) standard or the Joint Photographic Experts Group (JPEG) standard.

The controller unit 205 further controls operations of the sheet processing apparatus 200. The sheet processing apparatus 200 corresponds to the sheet holding system apparatus and the sheet treatment apparatus described with reference to FIG. 1. A sheet management unit 211 is a module for managing information about types or the like of sheets which the digital printing machine 102 is capable of processing. The information about types or the like of sheets which the digital printing machine 102 is capable of processing is stored in the HDD 209.

Figure 3:
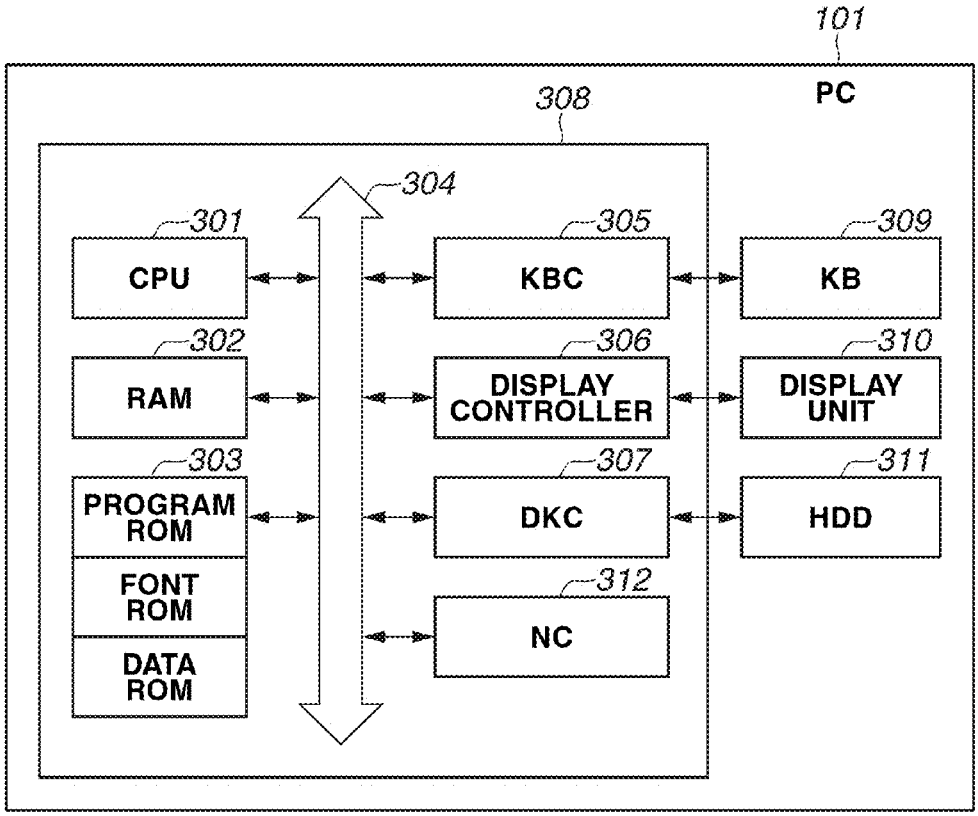
FIG. 3 is a block diagram illustrating a configuration of a computer, such as a personal computer (PC), according to the first exemplary embodiment.

FIG. 3 is a block diagram illustrating a configuration of the computer (PC) 101 according to the first exemplary embodiment.

Referring to FIG. 3, a CPU 301 executes programs, such as an operating system (OS), a general application, and a bookbinding application, stored in a program ROM included in a ROM 303 or loaded on a RAM 302 from an HDD 311. The ROM 303 further includes a font ROM and a data ROM. The RAM 302 functions as a main memory, a work area, etc., for the CPU 301. A keyboard controller (KBC) 305 controls inputs from a keyboard 309 or a pointing device (not illustrated). A display controller 306 controls displaying on a display unit 310. A disk controller (DKC) 307 controls access to the HDD 311, which stores a boot program, various applications, font data, user files, etc. A network controller (NC) 312 is connected to the network 100 and performs communication control processing with another device connected to the network 100. A bus 304 connects the CPU 301, the RAM 302, the ROM 303, and the various controllers with one another and is used to transfer data signals and control signals.

Figure 4:
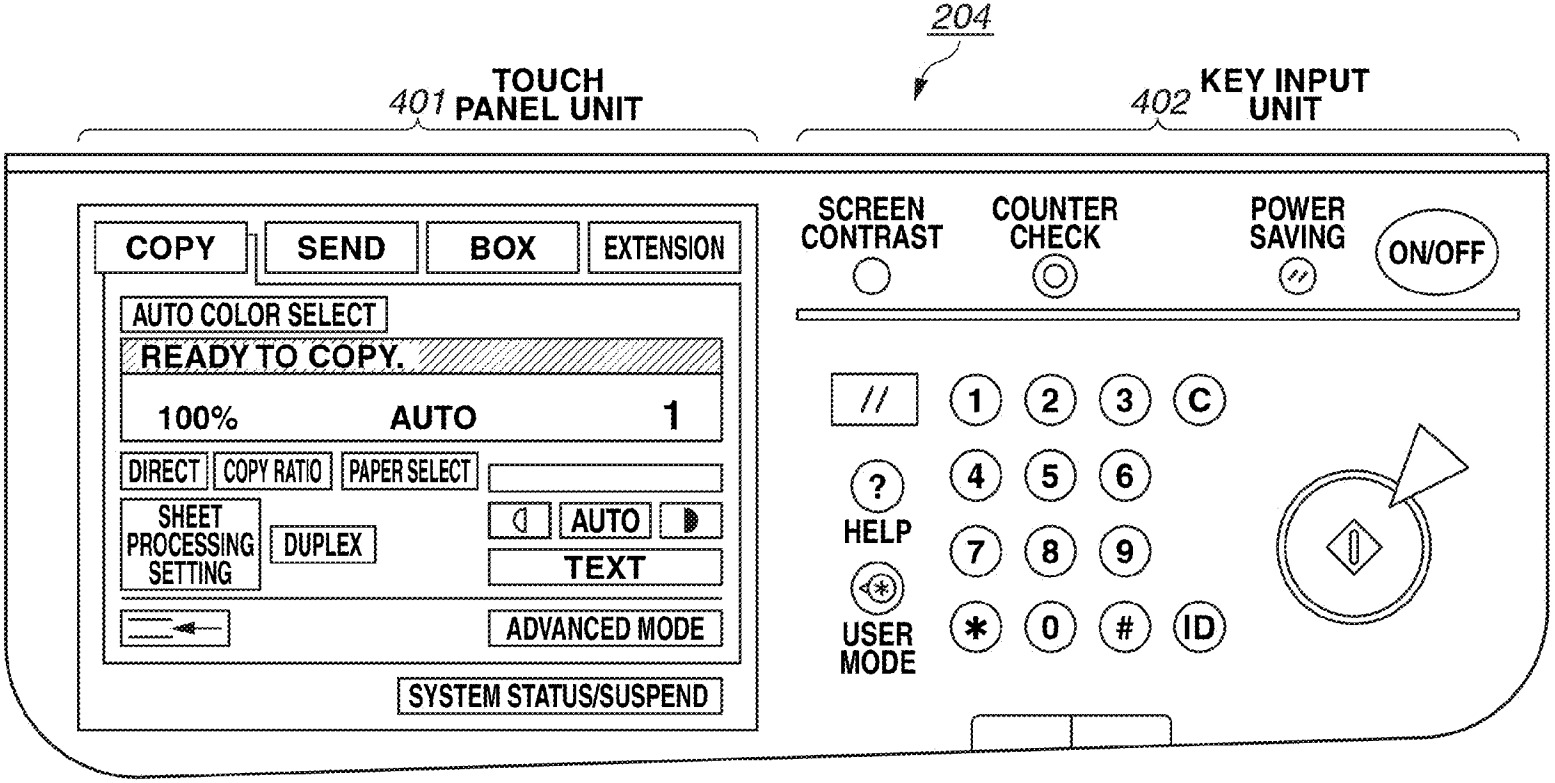
FIG. 4 is a top plan view of an operation unit of the digital printing machine according to the first exemplary embodiment.

FIG. 4 is a top plan view of the operation unit 204 of the digital printing machine 102 according to the first exemplary embodiment.

The operation unit 204 includes a key input unit 402, which can receive a user operation with hardware keys, and a touch panel unit 401, which is an example of a display unit that can receive a user operation with software keys (displayed keys). A screen displayed on a display portion of the touch panel unit 401 illustrated in FIG. 4 represents an example of an operation screen displayed under the control of the controller unit 205. An item or items that are displayed on the display portion or that are operable on the display portion change depending on a user operation on the screen or various statuses of the apparatuses. For example, when the user operates the touch panel unit 401, a UI function program 509, described below, recognizes content of the user operation on the touch panel unit 401, and the digital printing machine 102 performs processing according to the recognized content.

Figure 5:
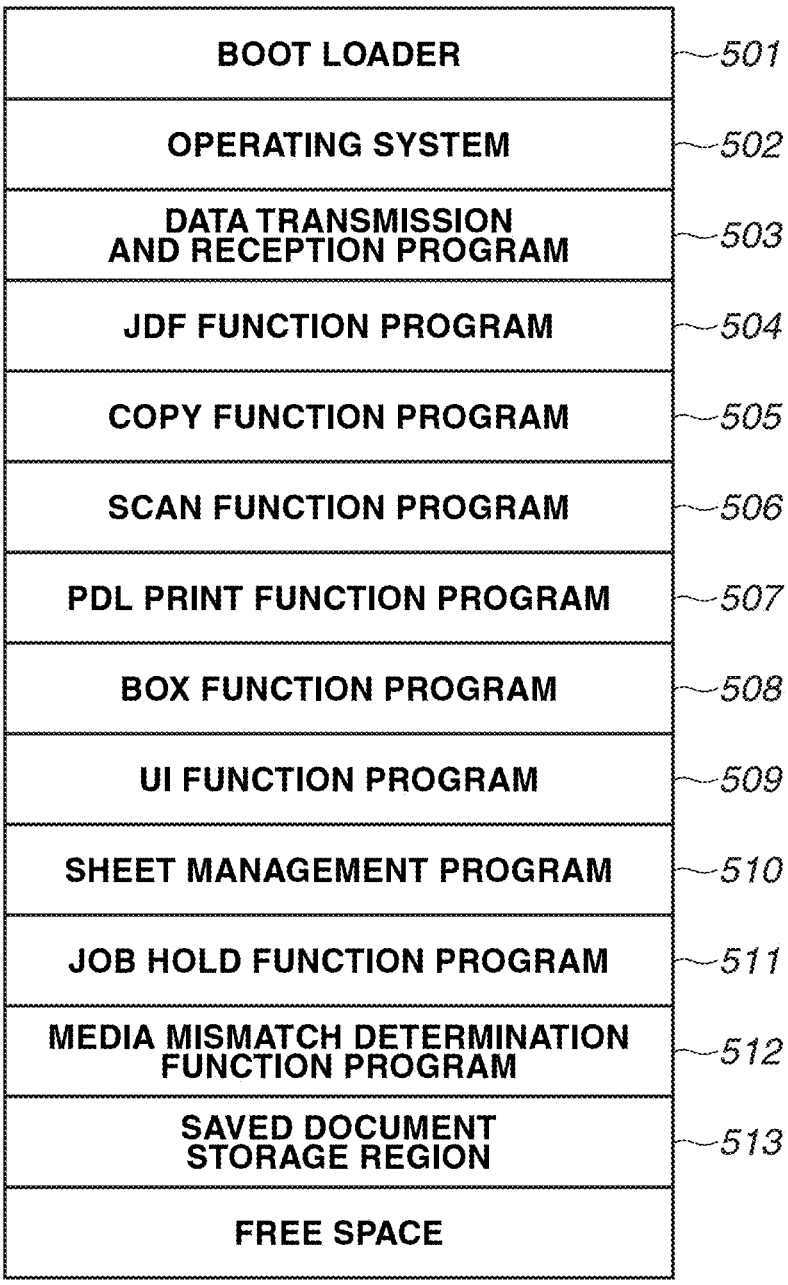
FIG. 5 illustrates programs installed on the digital printing machine according to the first exemplary embodiment.

FIG. 5 illustrates programs to be executed by the digital printing machine 102.

The programs illustrated in FIG. 5, which are stored in the ROM 207, are read out and executed by the CPU 212 of the controller unit 205 of the digital printing machine 102.

A boot loader 501 includes programs that are executed immediately after power-on of the digital printing machine 102. The programs include programs for executing various boot sequences required for system start. An operating system 502 is a program designed to provide execution environments of various programs to implement the functions of the digital printing machine 102. The operating system 502 mainly provides functions for resource management operations of memories of the digital printing machine 102, such as the ROM 207, the RAM 208, and the HDD 209, and basic input/output control operations of the various units illustrated in FIG. 2. A data transmission and reception program 503 performs transmission and reception processing to be performed when a request for inputting or outputting data is issued via the external I/F 202. More specifically, the data transmission and reception program 503 contains a protocol stack, such as Transmission Control Protocol/Internet Protocol (TCP/IP), and controls communications of various pieces of data with an external device or the like connected via the network 100. Communication processing performed by the data transmission and reception program 503 is specialized for the transmission and reception levels of data packets and the communication with a HyperText Transfer Protocol (HTTP) server or the like, and does not include analytical processing about content of data, described below. The analytical processing of data is performed by the controller unit 205 based on descriptive content of another program.

A Job Definition Format (JDF) function program 504 is a program for performing a JDF print function, which the controller unit 205 performs in response to an instruction from the external I/F 202 when the digital printing machine 102 receives JDF job data via the external I/F 202. When performing the JDF print function, the controller unit 205 sequentially gives instructions for operations of the concerned devices in an appropriate order based on the processing order and processing condition described in the JDF function program 504. As a result of the instructions, the concerned devices are controlled to eventually perform JDF print processing. The concerned devices include the sheet processing apparatus 200, the printer unit 1000, the HDD 209, the compression and decompression unit 210, and the RAM 208. The JDF function program 504 further includes a program for performing analytical processing of JDF job data received via the external I/F unit 2002, processing for determining whether incorrect settings are included in JDF as a result of the analytical processing, and processing for changing settings to resolve the incorrect settings.

A copy function program 505 is a program for performing a copy function, which the controller unit 205 performs in response to an instruction from the operation unit 204 when the user of the digital printing machine 102 issues an instruction for the copy function via the operation unit 204. When performing the copy function, the controller unit 205 sequentially gives instructions for operations of the concerned devices in an appropriate order based on the processing order and processing condition described in the copy function program 505. As a result of the instructions, the concerned devices are controlled to eventually perform copy processing. The concerned devices include the scanner 224, the printer unit 1000, the sheet processing apparatus 200, the HDD 209, the compression and decompression unit 210, and the RAM 208.

A scan function program 506 is a program for performing a scan function, which the controller unit 205 performs in response to an instruction from the operation unit 204 when the user of the digital printing machine 102 issues an instruction for the scan function via the operation unit 204. The controller unit 205 controls various modules, such as the scanner 224, the HDD 209, the compression and decompression unit 210, and the RAM 208, according to the processing order and processing condition described in the scan function program 506. The controller unit 205 sequentially gives instructions for operations of the concerned devices in an appropriate order to eventually perform scan processing.

A PDL print function program 507 is a program for performing a PDL print function, which the controller unit 205 performs in response to an instruction from the external I/F 202 when the digital printing machine 102 receives PDL data (print job data) via the external I/F 202. When performing the PDL print function, the controller unit 205 sequentially gives instructions for operations of the concerned devices in an appropriate order based on the processing order and processing condition described in the PDL print function program 507. As a result of the instructions, the concerned devices are controlled to eventually perform PDL print processing. The concerned devices include the sheet processing apparatus 200, the printer unit 1000, the HDD 209, the compression and decompression unit 210, and the RAM 208.

A box function program 508 is a program for performing a box function, which the controller unit 205 performs in response to an instruction from the operation unit 204 when the user of the digital printing machine 102 issues an instruction for the box function via the operation unit 204. When performing the box function, the controller unit 205 sequentially gives instructions for operations of the concerned devices in an appropriate order based on the processing order and processing condition described in the box function program 508. The concerned devices include the scanner 224, the printer unit 1000, the sheet processing apparatus 200, the HDD 209, the compression and decompression unit 210, and the RAM 208. The user can change the original settings of a job for job data stored in the HDD 209 according to the box function program 508, to enable re-performing the job with the changed settings.

A UI function program 509 is provided for controlling the operation unit 204. The UI function program 509 recognizes content input by the user of the digital printing machine 102 via the operation unit 204, and thus performs appropriate screen transition and gives a processing request instruction to the controller unit 205.

A sheet management program 510 is provided for performing a management function about sheets which the digital printing machine 102 is capable of using. Sheet-related information managed by the sheet management program 510 is stored in the HDD 209.

A job hold function program 511 is a program performed by the controller unit 205 when the user of the digital printing machine 102 issues an instruction for the job hold function via the operation unit 204. The job hold function is a function to store data to be printed in the HDD 209 of the digital printing machine 102 until a print instruction is issued from the user and then to perform printing according to data for which the print instruction has been received from the user. When performing print processing according to the job hold function, the controller unit 205 sequentially gives instructions for operations of the concerned devices in an appropriate order based on the processing order and processing condition described in the job hold function program 511. The concerned devices include the printer unit 1000, the sheet processing apparatus 200, the HDD 209, the compression and decompression unit 210, and the RAM 208. The user can change the original settings of a job for job data stored in the HDD 209 according to the job hold function program 511, to enable re-performing the job with the changed settings.

The job hold function is performed in the following processing order in a case where print job data is stored into the digital printing machine 102 from the computer 101, which is an external device. The PDL print function program 507 or the JDF function program 504 gives an instruction for storage in the job hold function instead of performing print processing on job data. A printing application that runs on the computer 101, which generates a print job, specifies whether to cause the PDL print function program 507 or the JDF function program 504 to perform print processing or to give an instruction for storage in the job hold function. The controller unit 205 reflects the specified processing in the set attribute of job data to be processed by the PDL print function program 507 or the JDF function program 504. The PDL print function program 507 or the JDF function program 504 performs switching of processing based on the set attribute.

A media mismatch determination function program 512 is provided for performing a function to cause the controller unit 205 to perform the following determination when the user of the digital printing machine 102 gives an instruction for executing a media mismatch determination. The media mismatch determination is to determine whether attribute information of a sheet to be used for a print job is not registered with any sheet holding unit and whether there is no remaining amount of a sheet to be used for the print job. The controller unit 205 retrieves attribute information of sheets which the digital printing machine 102 is capable of using, stored in the HDD 209 of the digital printing machine 102 according to the sheet management program 510. Then, the controller unit 205 compares the retrieved attribute information with attribute information of sheets to be used for job data held by the job hold function program 511, to determine whether attribute information of a sheet to be used for a print job is not registered with any sheet holding unit. In addition, the controller unit 205 detects the remaining amount of sheets with a sensor mounted in each sheet holding unit, to determine whether there is no remaining amount of a sheet to be used for the print job. A result of the media mismatch determination performed by the media mismatch determination function program 512 is retained with a flag and is stored in the RAM 208.

The attribute information of a sheet to be used for a print job includes at least one of the sheet size, the sheet grammage, the sheet surface property, the sheet shape, and the sheet color.

The ROM 207 does not need to store all of the function programs illustrated in FIG. 5. Instead, the ROM 207 may store only a part of the function programs or may store another function program in addition to the function programs.

A saved document storage region 513 is a storage region for saved job data managed by the job hold function program 511. Job data to be saved, received from an external device, is stored in the saved document storage region 513 together with print settings thereof.

Figure 6:
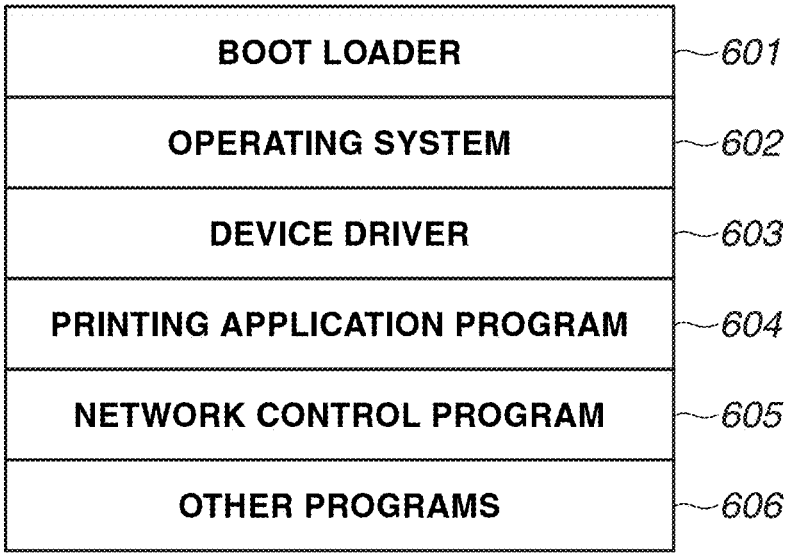
FIG. 6 illustrates an example of a configuration of programs installed on the computer according to the first exemplary embodiment.

FIG. 6 illustrates a configuration of programs installed on the computer 101, which transmits job data to the digital printing machine 102 configured as described above.

Operations of a boot loader 601 and an operating system 602 are similar to those of the boot loader 601 and the operating system 502, respectively, illustrated in FIG. 5, and the detailed descriptions thereof are, therefore, omitted. A device driver 603 includes a program for controlling various hardware devices connected to the computer 101. The device driver 603 further includes a program for controlling the KBC 305, the display controller 306, and the DKC 307. A printing application program 604 is a general term for programs that run on the computer 101 and are designed to provide various functions and services to the user of the digital printing system. The printing application program 604 has a function to generate or edit data of a print job. The printing application program 604 further has a function to convert data of a print job into that associated with print settings set with various print formats via a setting screen (not illustrated).

Furthermore, the printing application program 604 is able to conversely convert the setting values included in the print settings into internal information required for controlling corresponding display items on the setting screen of the printing application program 604. The printing application program 604 further has a function to select a print setting file stored in the HDD 311 to generate print job data. The printing application program 604 has a capability to convert print settings into the PDL command format or the JDF format and to combine the print settings with print target data to generate print job data.

A network control program 605 is a program that is executed when the computer 101 transmits print job data generated by the printing application program 604 to the digital printing machine 102 connected to the computer 101 via the network 100. The network control program 605 can be configured to further have a function to transmit print data and then acquire progress information of a print job performed by the digital printing machine 102. Other programs 607 include programs other than the above-described programs, the detailed description thereof is omitted.

Figure 7:
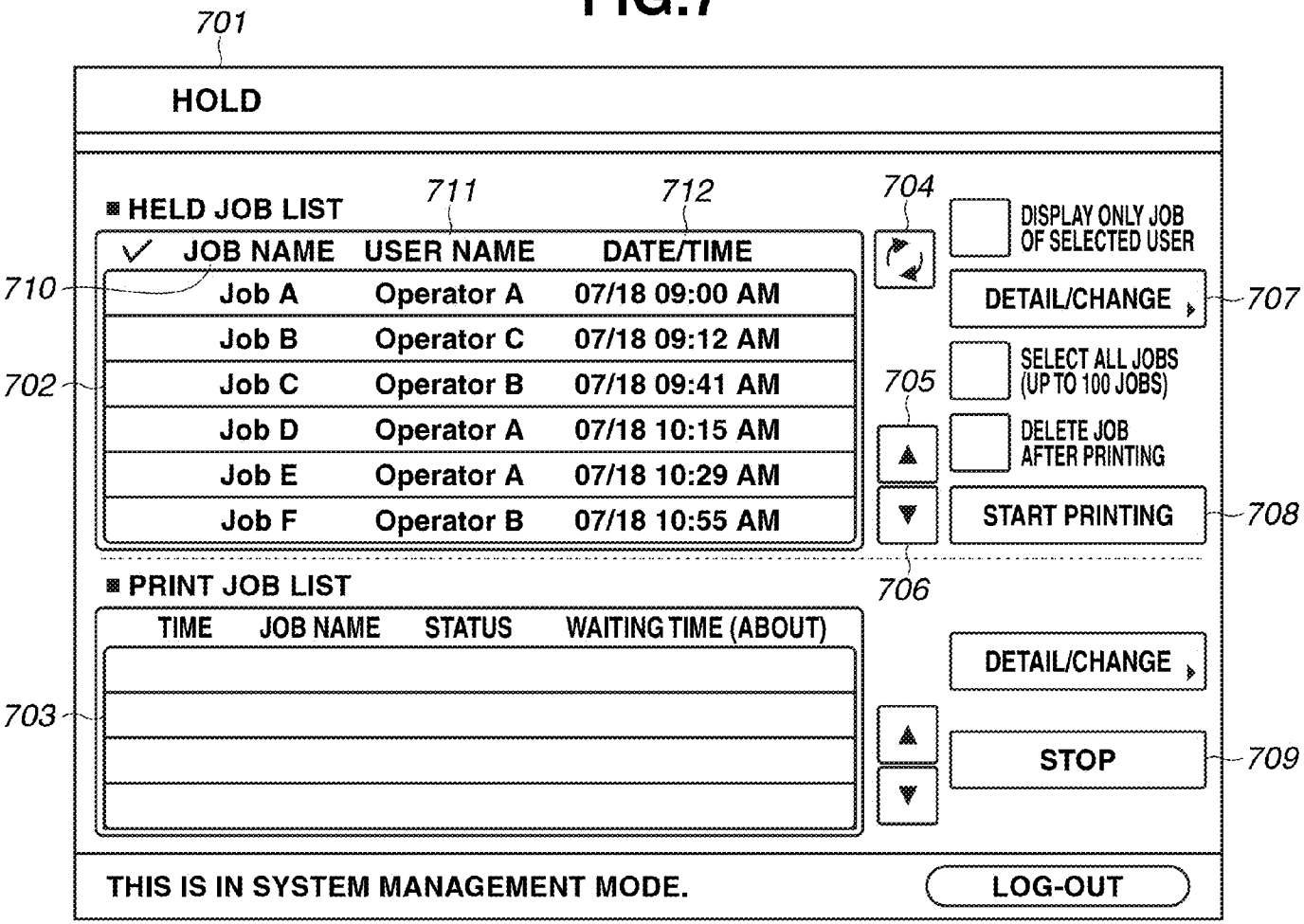
FIG. 7 illustrates an example of an operation screen for a job hold function displayed on the operation unit in the digital printing machine according to the first exemplary embodiment.

FIG. 7 illustrates an example of an operation screen 701 for the job hold function displayed on the operation unit 204 in the digital printing machine 102 according to the first exemplary embodiment. The operation screen 701 includes a plurality of display regions and a plurality of operation buttons. Significant points in describing the first exemplary embodiment are described below. The job hold function is a function to store print target data in the HDD 209 of the digital printing machine 102 until a print instruction is received from the user and then to perform printing according to data for which the print instruction has been received from the user. According to the job hold function, the digital printing machine 102 can store a plurality of pieces of data in the HDD 209. The job hold function enables the user to select a print job from among a plurality of pieces of print job data reserved in the HDD 209, so that printing can be performed regardless of the order in which the plurality of pieces of print job data was reserved.

A held job list 702 is a region in which print job data stored in the saved document storage region 513 of the digital printing machine 102 is listed and displayed. In the example illustrated in FIG. 7, six pieces of print job data are displayed. The digital printing machine 102 is able to store a greater number of pieces of print job data in the HDD 209 than the number of pieces of data displayable at a time in the held job list 702. For example, in a case where seven or more pieces of print job data are stored in the HDD 209, the user can press a scroll button 705 or 706 to sequentially display all of the stored pieces of print job data in the held job list 702. Print job data displayed in the held job list 702 includes a job name 710, a user name 711, and a date/time field 712, which indicates the date and time when the corresponding job was stored in the digital printing machine 102.

Suppose that a user who operates the job hold screen selects a job to be printed based on the information displayed in the held job list 702.

Now, suppose that a user who operates the job hold screen for the job hold function of the digital printing machine 102 is an "Operator A". There are three jobs with the user name "Operator A" among a plurality of jobs displayed in the held job list 702 illustrated in FIG. 7. The three jobs include a "Job A2", a "Job D", and a "Job E".

Here, there may be a use case where the user who operates the digital printing machine 102 selects and prints a print job of a user whose user name does not agree with that of the user who operates the digital printing machine 102. However, in most of major use cases, the user selects and prints the user's own print job as a print job to be printed. For the above reasons, in the following description, a case where the user selects the user's own print job to perform printing is described for example. However, the present invention can also be applied to a case where the user selects a print job of another person to perform printing.

When the user presses a portion of a print job displayed in the held job list 702 with the finger or the like, the print job enters the selected state, i.e., a state in which the print job is selected as an object to be printed. The details of processing for selecting a print job are described below with reference to subsequent figures.

A print job list 703 is provided to display a list of print jobs for which print processing has been started or print jobs that are waiting for print processing to be started. In the example illustrated in FIG. 7, there exists no print job for which print processing has been started. In other words, the print job list 703 indicates that the printer unit 1000 of the digital printing machine 102 is in the idle state.

A DETAIL/CHANGE button 707 is provided to check for the details of a print job that is in the selected state in the held job list 702 or to carry out screen transition to another screen for changing the print specifications.

A START PRINTING button 708 is provided to give an instruction to start print processing of a print job selected in the held job list 702. When the START PRINTING button 708 is pressed while a print job is selected from among print jobs displayed in the held job list 702, the selected print job moves to the print job list 703 to be displayed therein. A STOP button 709 is provided to stop execution of a print job for which print processing has been started in response to the START PRINTING button 708 being pressed.

A media mismatch determination button 704 is provided to perform a media mismatch determination for a print job selected in the held job list 702. The media mismatch determination is to determine whether attribute information of a sheet to be used for a print job is registered with any sheet holding unit and to determine whether there exists a remaining amount of sheets to be used for the job if the attribute information is registered with any sheet holding unit. For example, suppose that a print job 1 is set up to use only "sheet A". Then, suppose that "sheet A" is registered with any sheet holding unit included in the digital printing machine 102, and that "sheets A" are stored in that sheet holding unit and there exists a remaining amount of "sheets A" (case 1). In that case 1, the result of the media mismatch determination performed with the media mismatch determination button 704 pressed indicates that the digital printing machine 102 is ready to use "sheet A" to be used for the print job 1.

Suppose, as another example, that, when the print job 1 is set up to use only "sheet A", "sheet A" is registered with any sheet holding unit included in the digital printing machine 102, but there exists no remaining amount of "sheets A" in that sheet holding unit (case 2). In that case 2, the result of the media mismatch determination performed with the media mismatch determination button 704 pressed indicates that, while "sheet A" is registered with any sheet holding unit, the digital printing machine 102 is in a state where there exists no remaining amount of "sheets A" in that sheet holding unit. To solve this issue in that case, the user just has to replenish the sheet holding unit with "sheets A".

Suppose, as a further example, that, when the selected print job 1 is set up to use only "sheet A", "sheet A" is not registered with any sheet holding unit included in the digital printing machine 102 (case 3). In that case 3, the result of the media mismatch determination performed with the media mismatch determination button 704 pressed indicates that, since "sheet A" to be used for the selected print job is not registered with any sheet holding unit, the digital printing machine 102 is not ready to use "sheet A". To solve this issue in that case, the user has to register setting information "sheet A" with any sheet holding unit and to replenish that sheet holding unit with "sheets A".

In the above-described cases 2 and 3, if the user presses the START PRINTING button 708 after selecting a print job, the digital printing machine 102 tries to feed sheets that are not ready to be used. Therefore, at that stage, a media mismatch occurs, so that print processing is suspended. Thus, the productivity in the digital printing machine 102 may decrease.

To solve these issues in the first exemplary embodiment, the media mismatch determination button 704 has a function to allow the user to confirm, prior to pressing the START PRINTING button 708, whether sheets to be used for the selected print job exist in the digital printing machine 102. Thus, the user can start print processing after registering sheets or replenishing a sheet holding unit based on the result of the media mismatch determination performed with the media mismatch determination button 704 pressed. Accordingly, the user can make preparations of sheets before the start of a print job. Therefore, such a disadvantageous situation can be reduced that a media mismatch occurs after the start of the print job, thus suspending print processing by the digital printing machine and leading to low productivity.

Specific examples of control operations according to the first exemplary embodiment are described with reference to FIGS. 8 to 12.

FIG. 8 illustrates an example of a sheet management table used to manage information about sheets that are held in the respective sheet holding units in the digital printing machine 102 according to the first exemplary embodiment. The sheet management table is stored in the HDD 209 and can be referred to by the CPU 212.

In the example illustrated in FIG. 8, three pieces of information, including the size 812, the media type 813, and the remaining amount 814, are managed with a sheet holding unit ID 811 used as a key with respect to each of ten sheet holding units included in the digital printing machine 102. The remaining amount of sheets is detected by a sensor included in each sheet holding unit.

For example, row 801 indicates that the size of a sheet held in a sheet holding unit (ID=1) is A4, the media type is plain paper 1, and the remaining amount is 3. A numerical value indicated by the remaining amount 814 represents the following meaning:

3: full (100%)
2: small remaining amount (25%)
1: very small remaining amount (less than 5%)
0: no remaining amount (0%)

For example, "full (100%)" means a state where 3,000 sheets are held in a sheet holding unit capable of holding 3,000 sheets. "Small remaining amount (25%)" means a state where 750 sheets are held in a sheet holding unit capable of holding 3,000 sheets. "Very small remaining amount (less than 5%)" means a state where less than 150 sheets are held in a sheet holding unit capable of holding 3,000 sheets. "No remaining amount (0%)" means a state where no sheets are held (i.e., the number of sheets remaining is zero) in a sheet holding unit capable of holding 3,000 sheets.

The precision of detection for the remaining amount of sheets can be increased in more fines by increasing the precision of a remaining amount sensor. However, the digital printing machine 102 according to the first exemplary embodiment performs a remaining amount detection specified as described above.

FIGS. 9A, 9B, and 9C illustrate sheet information that is used for a job A, a job D, and a job E, respectively, illustrated in FIG. 7.

The sheet information illustrated in FIGS. 9A, 9B, and 9C is retained by the job hold function program 511 illustrated in FIG. 5 storing print settings simultaneously when storing print job data into the saved document storage region 513. The sheet information that is used for a print job is included in the print settings.

FIG. 9A indicates that the job A uses two types of sheets, including a sheet the size of which is A4 and the media type of which is "plain paper 1" and a sheet the size of which is A4 and the media type of which is "double-sided coated paper 1". Also, FIG. 9B indicates that the job D uses two types of sheets, including a sheet the size of which is LTR and the media type of which is "plain paper 1" and a sheet the size of which is 11×17 and the media type of which is "plain paper 1". Similarly, FIG. 9*c* indicates that the job E uses three types of sheets, including a sheet the size of which is A4 and the media type of which is "plain paper 1", a sheet the size of which is A4 and the media type of which is "colored paper (red)", and a sheet the size of which is A3 and the media type of which is "double-sided coated paper 2".

Figure 10:
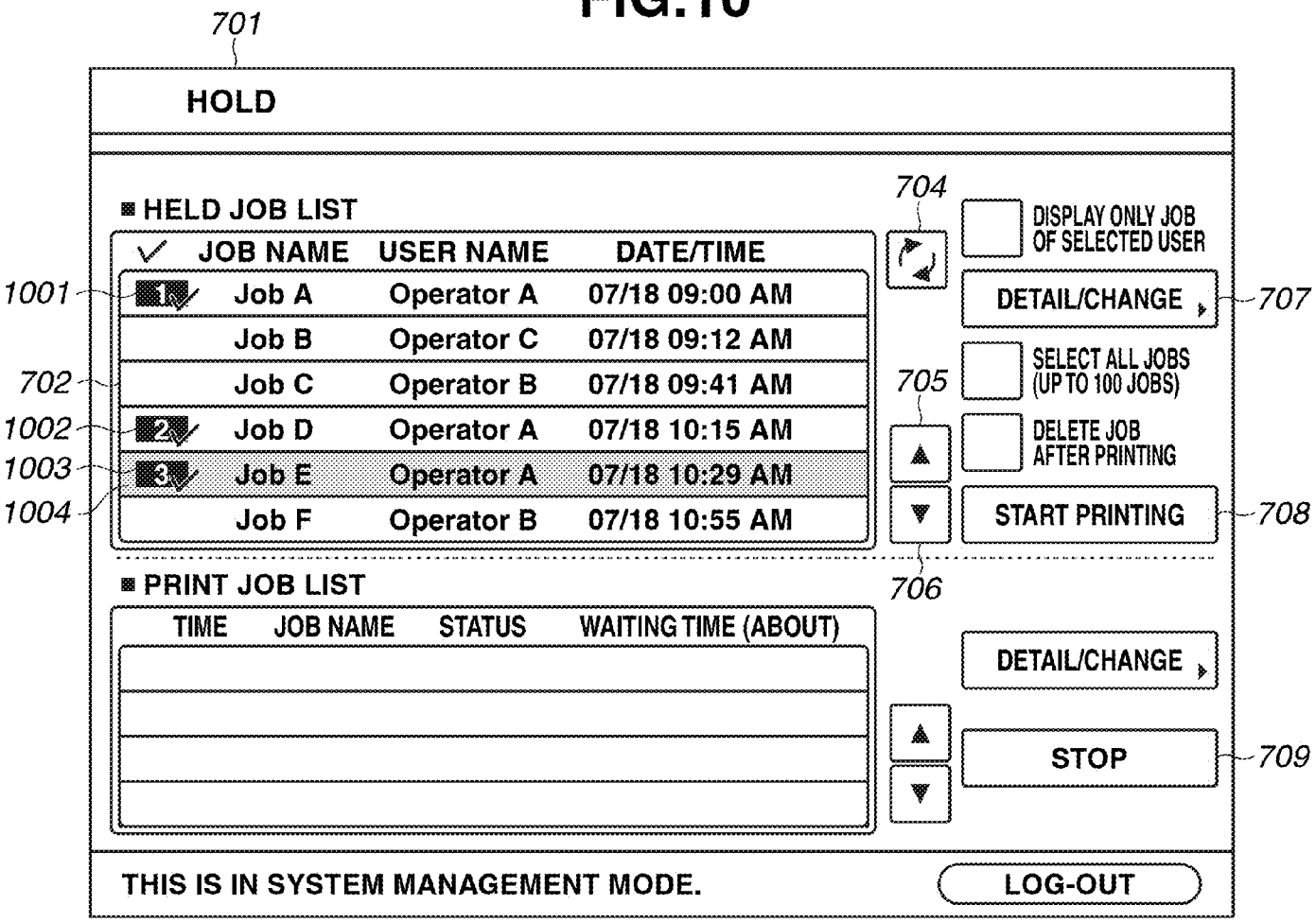
FIG. 10 illustrates an example of an operation screen for the job hold function displayed on the operation unit in the digital printing machine according to the first exemplary embodiment.

FIG. 10 illustrates an example of an operation screen 701 for the job hold function displayed on the operation unit 204 in the digital printing machine 102 according to the first exemplary embodiment. The example illustrated in FIG. 10 indicates an example of an operation screen displayed immediately after an operator A operates the operation screen for the job hold function displayed on the operation unit 204 and selects print jobs. Portions similar to those illustrated in FIG. 7 are denoted by the same reference numerals. In the example illustrated in FIG. 10, the operator A has selected three jobs in turn, including the job A, the job D, and the job E in this order. The jobs in the selected state are indicated with selection marks 1001, 1002, and 1003, which are located on the left-hand side of the job name field and are assigned numerical values indicating the order of selection. The highlighted field 1004 indicates that the job E has been last selected. This represents the current selected state in the held job list 702. Thus, when the user presses the DETAIL/CHANGE button 707 under such a state, the user becomes able to check for the detailed information of the job E and to change the settings thereof.

Figure 11:
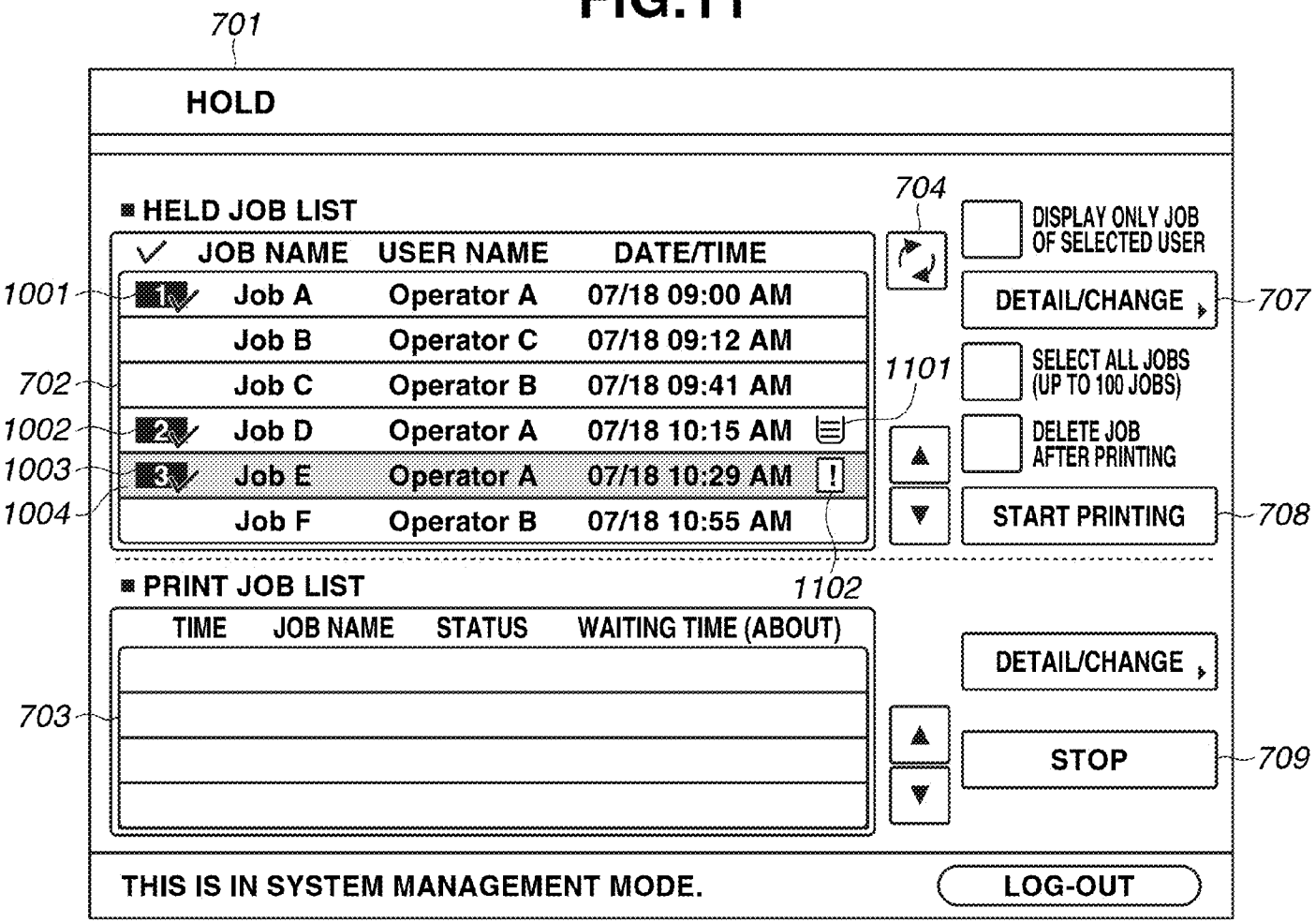
FIG. 11 illustrates an example of an operation screen for the job hold function displayed on the operation unit in the digital printing machine according to the first exemplary embodiment.

FIG. 11 illustrates an example of an operation screen 701 for the job hold function displayed on the operation unit 204 in the digital printing machine 102 according to the first exemplary embodiment. The example illustrated in FIG. 11 indicates an example of an operation screen displayed immediately after the media mismatch determination has been performed on each of the print jobs displayed in the held job list 702 in the state illustrated in FIG. 10 in response to the print jobs being listed and displayed in the held job list 702.

Portions of the operation screen illustrated in FIG. 11 similar to those illustrated in FIG. 10 are denoted with the same reference numerals, and the description thereof is not repeated.

Referring to FIG. 11, with respect to each of three jobs selected by the user (job A, job D, and job E), the media mismatch determination checks for matching between sheets to be used for each job and sheets set in (registered with) each sheet holding unit of the digital printing machine 102.

A no-remaining amount mark 1101 indicates that although a sheet to be used for a print job is set in (registered with) a sheet holding unit, the remaining amount thereof is zero (there is no remaining amount thereof). A mismatch mark 1102 indicates that a sheet of the sheet type (size and media type) to be used for a print job is not set in (registered with) any sheet holding unit.

For example, in the case of the job A, sheets to be used for that job are set in sheet holding units and the remaining amount of each sheet is not zero, as illustrated in FIGS. 8 and 9A. Accordingly, the user, when pressing the START PRINTING button 708, can become aware that the probability of occurrence of a media mismatch is very low, prior to giving an instruction to start printing.

In the case of the job D, sheets to be used for that job are set in sheet holding units, but the remaining amount of a part of the sheets is zero, as illustrated in FIGS. 8 and 9B. More specifically, the remaining amount of the sheet the size of which is "11×17" and the media type of which is "plain paper 1", which is set in the "sheet holding unit 9", is zero. Accordingly, when the user presses the START PRINTING button 708 under such a condition, a media mismatch (no-remaining amount) occurs at the stage of trying to feed sheets of the size "11×17", thus suspending print processing. This is indicated with the no-remaining amount mark 1101. The user, when recognizing the indication of the no-remaining amount mark 1101, has only to take appropriate steps, i.e., replenish the sheet holding unit 9 with sheets the size of which is "11×17" and the media type of which is "plain paper 1".

In the case of the job E, a sheet that is not set in (registered with) any sheet holding unit exists, as illustrated in FIGS. 8 and 9C. More specifically, the sheet the size of which is "A3" and the media type of which is "double-sided coated paper 2" is not set in any sheet holding unit. This is indicated with the mismatch mark 1102. Accordingly, the user becomes aware, prior to giving an instruction to start printing, that, when the user presses the START PRINTING button 708 under such a condition, a media mismatch (sheet type mismatch) occurs at the stage of trying to feed sheets of that type, thus suspending print processing. The user, when recognizing the indication of the mismatch mark 1102, can take appropriate steps, i.e., specify another sheet holding unit (desirably, a sheet holding unit that has not been determined to be used for the print job) and change the setting of a sheet for the specified sheet holding unit to the size "A3" and the media type "double-sided coated paper 2". Further, the user can replenish the specified sheet holding unit with sheets of that type. If sheets of another type are held in the specified sheet holding unit, the user can changes such sheets with sheets of that type. The shapes of the no-remaining amount mark 1101 and the mismatch mark 1102 are made different from each other. This enables the user to distinguishably recognize whether a sheet for a job is not set in (registered with) any sheet holding unit and whether, although the sheet is set in a sheet holding unit, the remaining amount of the sheet is zero.

As described above, the no-remaining amount mark 1101 or the mismatch mark 1102 is displayed in association with a print job having the possibility of occurrence of a media mismatch as a result of the media mismatch determination. This enables the user to avoid the print job being suspended.

Under the condition illustrated in FIG. 11, if the user presses the DETAIL/CHANGE button 707, the sheet sizes and the media types to be used for the selected job E (for example, as illustrated in FIG. 9C) are displayed. Here, media information that is not set in any sheet holding unit (for example, A3 and double-sided coated paper) can be highlighted to inform the user of a sheet that is not set in any sheet holding unit.

Furthermore, under the condition illustrated in FIG. 11, if the user selects the job D and presses the DETAIL/CHANGE button 707, the sheet sizes and the media types to be used for the selected job D (for example, as illustrated in FIG. 9B) are displayed. Here, the CPU 212 can blink sheet information indicating no-remaining amount. The CPU 212 can further blink the indication of a sheet holding unit in which the corresponding sheet is set. This enables the user to recognize sheet information, indicating the sheet size and the media type to be used for the job D and indicating no-remaining amount, and a sheet holding unit in which the corresponding sheet is set. In this way, even when the sheet size and the media type are displayed, the manner of display of sheet information indicating that a sheet is not set in any sheet holding unit and the manner of display of sheet information indicating the remaining amount of a sheet is zero are made different from each other. This enables the user to distinguishably recognize whether a sheet of the displayed size and type is not set in (registered with) any sheet holding unit and whether the remaining amount of the sheet is zero. While, in the present exemplary embodiment, media information that is not set in any sheet holding unit is highlighted and sheet information indicating no-remaining amount is blinked, this is not a restrictive one. Respective pieces of sheet information may be displayed in association with the no-remaining amount mark 1101 and the mismatch mark 1102.

FIG. 12 illustrates an example of a sheet management table used to manage information about sheets that are held in the respective sheet holding units in the digital printing machine 102 according to the first exemplary embodiment. The example illustrated in FIG. 12 represents a sheet management table obtained after the user has performed avoidance processing based on the screen illustrated in FIG. 11 and an operation performed thereon. The sheet management table illustrated in FIG. 12 is also stored in the HDD 209 and can be referred to by the CPU 212.

A point of difference from the table illustrated in FIG. 8 is that the media type for the sheet holding unit ID=4 is changed to "double-sided coated paper 2" and the sheet holding unit ID=4 is replenished with such sheets (the remaining amount is "3"). Another point of difference is that the sheet holding unit ID=9 is replenished with sheets so that the remaining amount is changed from "0" to "3".

Under the condition where the user has performed processing for registering sheets and replenishing sheet holding units to bring the sheet management table into the state illustrated in FIG. 12, when the user presses the media mismatch determination button 704 to update the result of the media mismatch determination, the operation screen returns to that illustrated in FIG. 10. Thus, the no-remaining amount mark 1101 and the mismatch mark 1102, which indicate factors that cause the occurrence of a media mismatch, disappear from the operation screen.

Under such a condition, when the user presses the START PRINTING button 708, the digital printing machine 102 starts print processing. Then, the user can become aware that the possibility that attribute information of sheets to be used for a print job is not registered with any sheet holding unit and there is no remaining amount of sheets to be used for the print job is very low, prior to the start of printing. Accordingly, not only the labor productivity of the user can be improved, but also the operation rate of the digital printing machine 102 can be raised. As a result, the convenience of the digital printing machine 102, which is intended for the print-on-demand (POD) market, can be enhanced.

Figure 13:
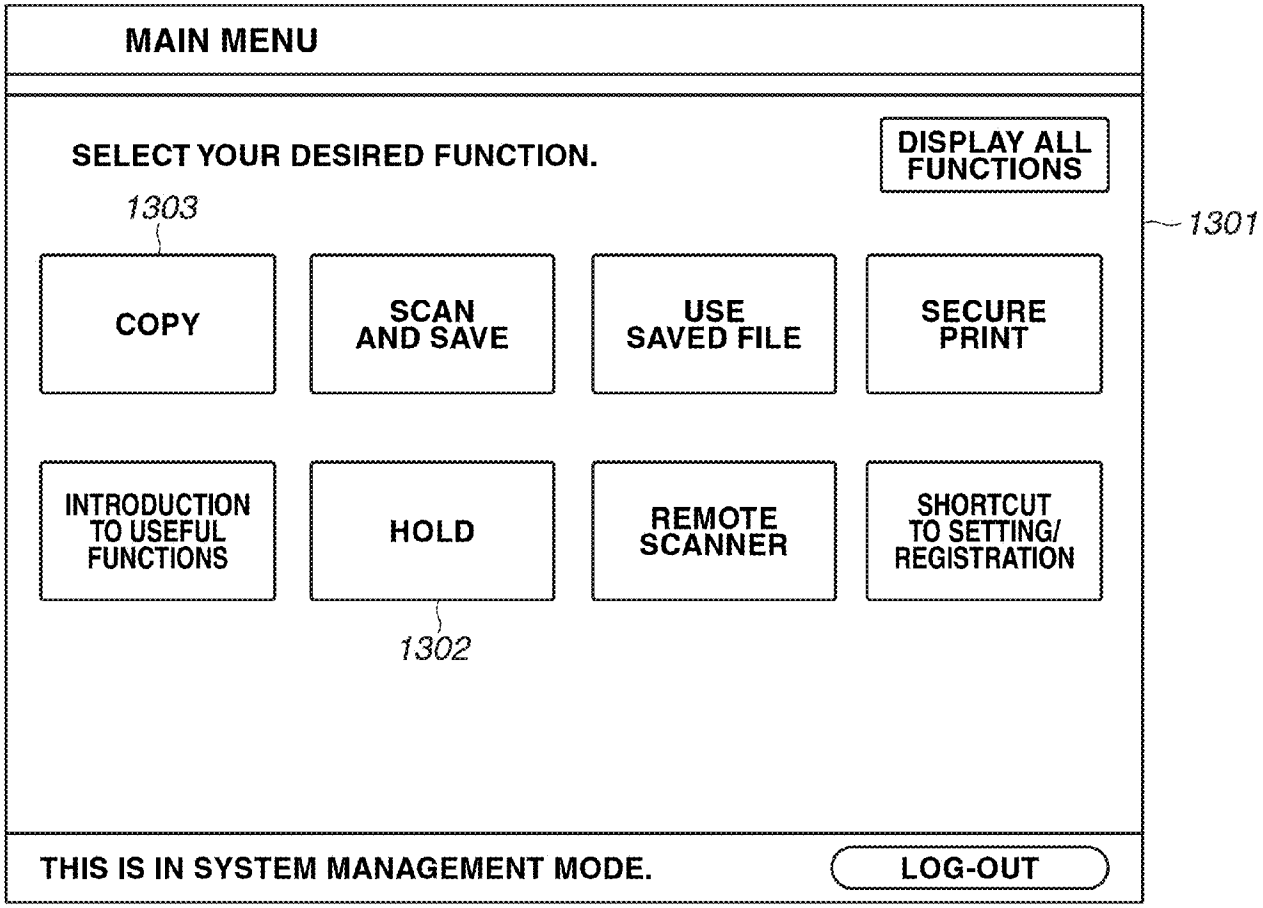
FIG. 13 illustrates an example of a main screen displayed on the operation unit in the digital printing machine according to the first exemplary embodiment.

FIG. 13 illustrates an example of a main screen 1301 displayed on the display unit of the operation unit 204 illustrated in FIG. 4. The main screen 1301 in the first exemplary embodiment lists selection buttons that are respectively associated with various functions, as illustrated in FIG. 13. The user is allowed to press a desired function selection button to shift the operation screen to a screen designed to use the desired function. The configuration of a main menu and the functions displayed in the main menu are only examples and are not restricted to those illustrated in FIG. 13.

A job hold function selection button 1302 is used to give an instruction to the display unit of the operation unit 204 to shift the operation screen to that for the job hold function illustrated in FIG. 7. In the first exemplary embodiment, the screen illustrated in FIG. 7 can be displayed after the job hold function selection button 1302 is pressed on the main screen such as that illustrated in FIG. 13.

Figure 14:
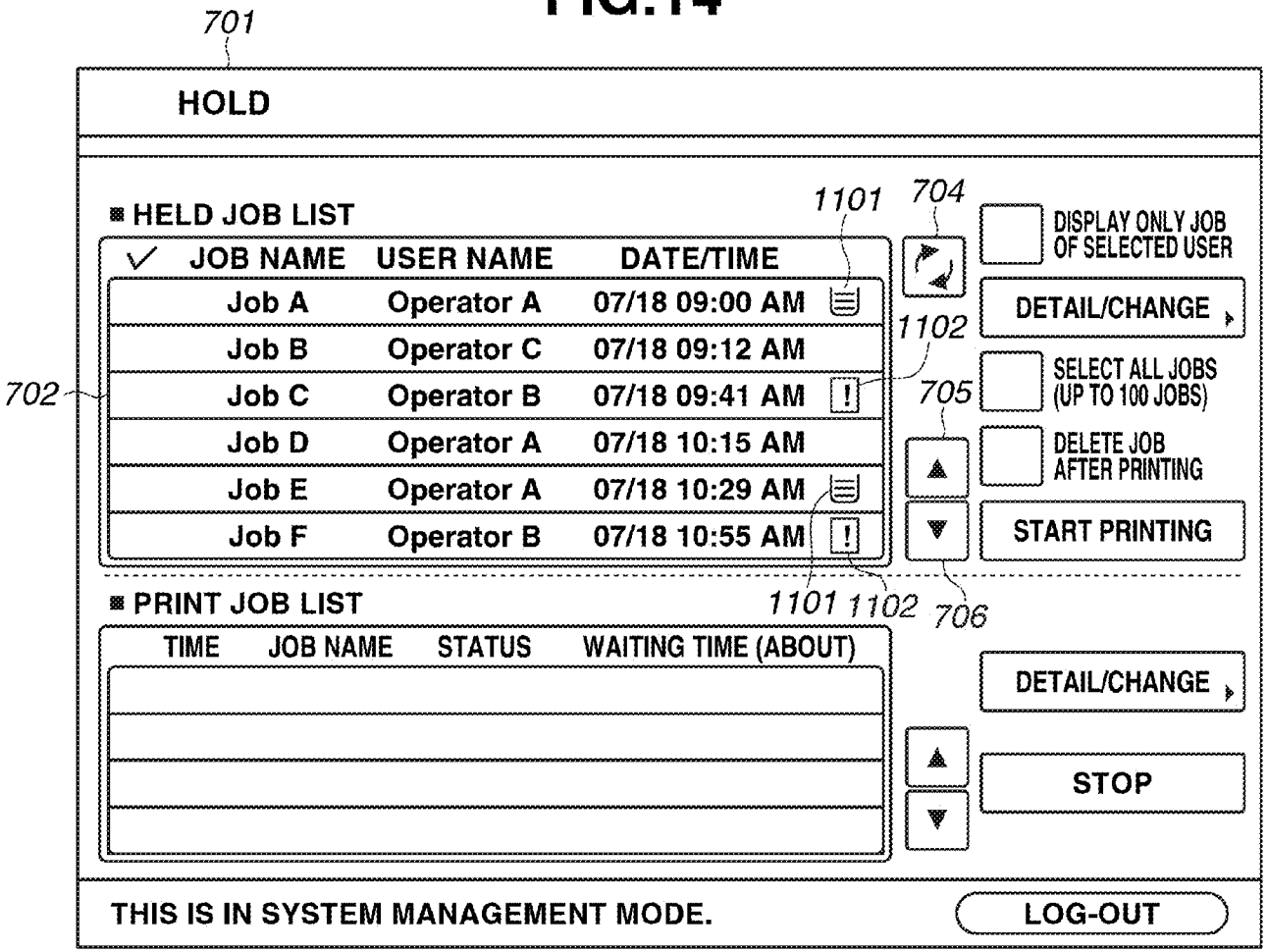
FIG. 14 illustrates an example of an operation screen for the job hold function displayed on the operation unit in the digital printing machine according to the first exemplary embodiment.

FIG. 14 illustrates an example of an operation screen 701 for the job hold function displayed on the operation unit immediately after the job hold function selection button 1302 is pressed on the main screen 1301 in the first exemplary embodiment. As illustrated in FIG. 14, the no-remaining amount marks 1101 and the mismatch marks 1102 are displayed from the start on the respective entries displayed in the held job list 702 for the job hold function.

The user can press the scroll button 705 or 706 to display further print jobs on the held job list 702. In that case also, the no-remaining amount mark 1101 or the mismatch mark 1102 is controlled to be displayed from the start, similar to the case illustrated in FIG. 14. Thus, the user intending to use the job hold function of the digital printing machine 102 is enabled to readily confirm, on the held job list 702, that attribute information of a sheet to be used for a print job is not registered with any sheet holding unit. The user is further enabled to readily confirm, on the held job list 702, that the remaining amount of the sheet to be used for the print job is zero if the attribute information is registered with any sheet holding unit.

An operation of the configuration according to the first exemplary embodiment is described below.

Figure 15:
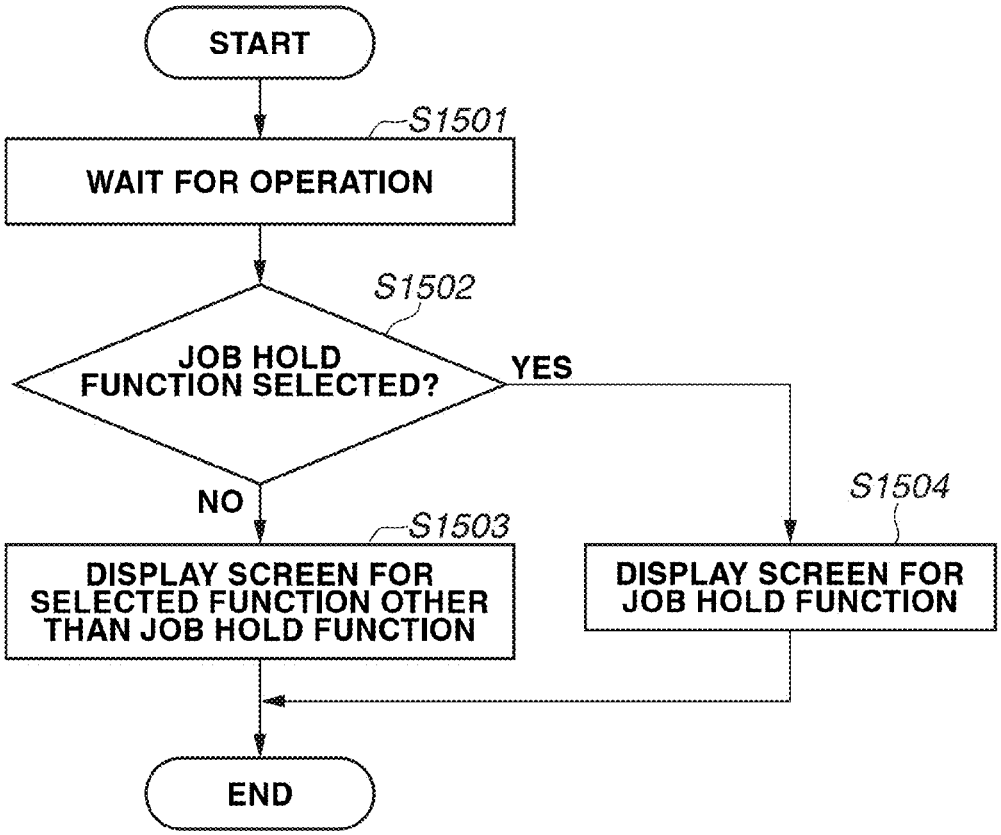
FIG. 15 is a flowchart illustrating a process performed on the main screen illustrated in FIG. 13 in the digital printing machine according to the first exemplary embodiment.

FIG. 15 is a flowchart illustrating a process performed on the main screen illustrated in FIG. 13 according to the first exemplary embodiment. The process is implemented by the CPU 212 in the controller unit 205 executing the UI function program 509, which is read from the ROM 207 or the HDD 209 and loaded onto the RAM 208. The process is started under the condition where the screen illustrated in FIG. 13 is displayed on the display unit of the operation screen 204.

First, in step S1501, the CPU 212 enters a state to wait for an operation by the user on the screen, illustrated in FIG. 13, displayed on the operation unit 204. The processing stays at step S1501 until a certain operation is performed by the user. When the user performs a certain operation on the operation unit 204, the processing proceeds to step S1502. In step S1502, the CPU 212 determines whether the operation performed is an operation to select the job hold function selection button 1302. If the result of the determination in step S1502 is true, i.e., if an instruction to display a screen for print jobs is issued by the user (YES in step S1502), the processing proceeds to step S1504. In step S1504, the CPU 212 calls up the operation screen 701 for the job hold function illustrated in FIG. 7. Then, the CPU 212 displays and lists, in the held job list 702, print job data stored in the saved document storage region 513 of the digital printing machine 102.

On the other hand, if the result of the determination in step S1502 is false (NO in step S1502), the processing proceeds to step S1503. In step S1503, the CPU 212 displays a screen for executing a process of the operation received in step S1501 other than that of the job hold function. The details of the process in step S1503 are not significant for describing the effect of the first exemplary embodiment, and, therefore, the description thereof is omitted.

Figure 16:
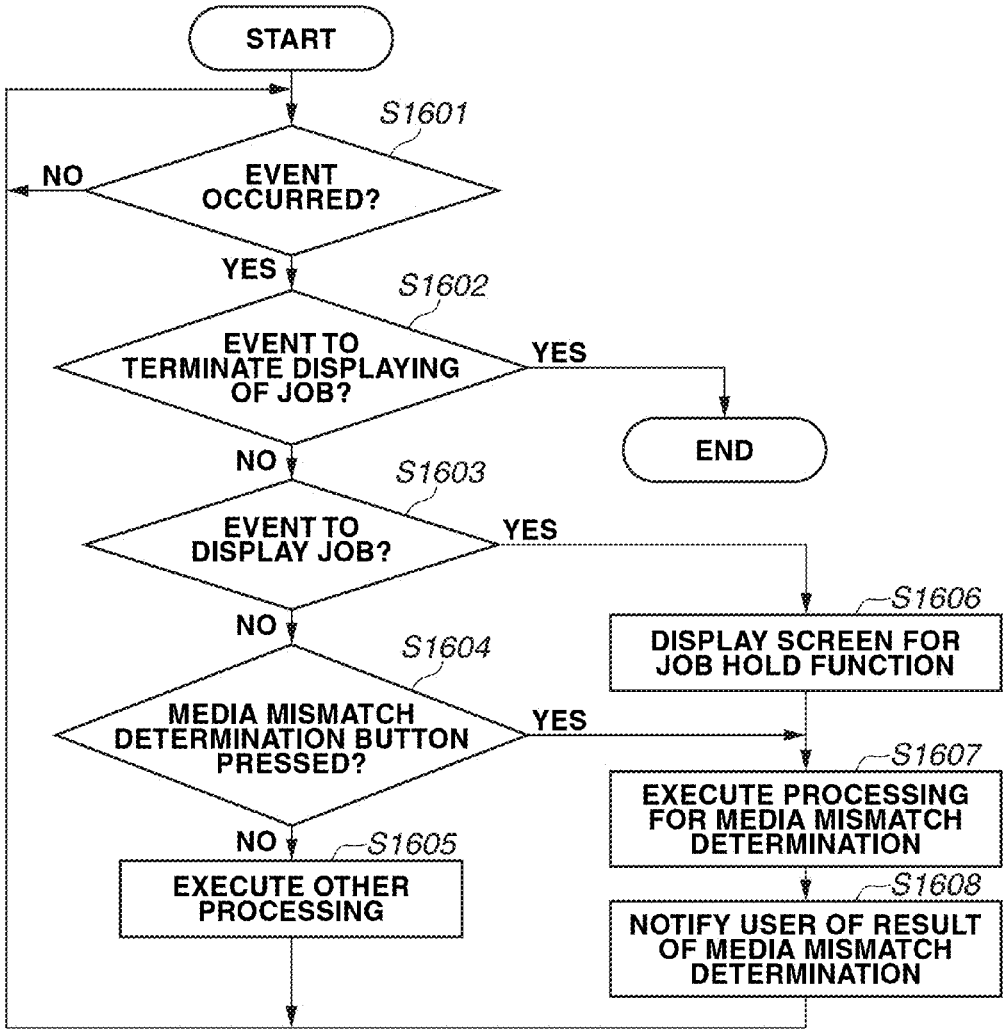
FIG. 16 is a flowchart illustrating processing performed by the digital printing machine according to the first exemplary embodiment.

FIG. 16 is a flowchart illustrating processing performed by the digital printing machine 102 according to the first exemplary embodiment. The processing is implemented by the CPU 212 in the controller unit 205 executing the UI function program 509, which is read from the ROM 207 or the HDD 209 and loaded onto the RAM 208. The processing is started with a state waiting for an operation by the user before the screen illustrated in FIG. 7 is displayed on the display unit of the operation unit 204.

First, in step S1601, the CPU 212 determines whether an event has occurred on the operation unit 204.

Processing in step S1601 is executed with respect to the operation waiting processing in step S1501 described above. The processing stays at step S1601 until a certain event occurs due to the operation by the user.

If a certain event occurs due to a certain operation by the user on the operation unit 204 (YES in step S1601), the processing proceeds to step S1602. In step S1602, the CPU 212 determines whether the occurred event is an event to terminate displaying of print jobs in the held job list 702. If the CPU 212 determines that the occurred event is an event other than the event to terminate displaying of print jobs in the held job list 702 (NO in step S1602), the processing proceeds to step S1603. In step S1603, the CPU 212 determines whether the occurred event is an event to display print jobs in the held job list 702. Processing in step S1603 is executed with respect to the processing in step S1502 described above. The event to display print jobs in the held job list 702 represents an event to shift the operation screen from the main screen illustrated in FIG. 13 to the operation screen for the job hold function in response to pressing of the job hold function selection button 1302. If the CPU 212 determines that the occurred event is an event to display print jobs in the held job list 702 (YES in step S1603), the processing proceeds to step S1606. In step S1606, the CPU 212 display a screen for the job hold function such as that illustrated in FIG. 7 or 14. Processing in step S1606 corresponds to the processing in step S1504 described above. Then, in step S1607, the CPU 212 performs the media mismatch determination for each of the print jobs displayed and listed in the held job list 702. The details of processing for performing the media mismatch determination are described below with reference to FIG. 17. When the media mismatch determination in step S1607 has been completed, the processing proceeds to step S1608. In step S1608, the CPU 212 performs processing for notifying the user of a result of the media mismatch determination performed in step S1607. The details of processing for notifying the user of a result of the media mismatch determination are described below with reference to FIG. 20. When the processing for notifying the user of a result of the media mismatch determination in step S1608 has been completed, the processing returns to step S1601, in which the CPU 212 enters a state waiting for an operation by the user. On the other hand, if the CPU 212 determines that the occurred event is not an event to display print jobs in the held job list 702 (NO in step S1603), the processing proceeds to step S1604.

In step S1604, the CPU 212 determines whether the media mismatch determination button 704 has been pressed. If the CPU 212 determines that the media mismatch determination button 704 has been pressed (YES in step S1604), the processing proceeds to step S1607. In step S1607, the CPU 212 performs the media mismatch determination for a print job selected in the held job list 702. Then, in step S1608, the CPU 212 performs processing for notifying the user of a result of the media mismatch determination performed in step S1607 for the print job selected in the held job list 702. The processing then returns to step S1601, in which the CPU 212 enters a state waiting for an event due to the operation by the user. In a case where the media mismatch determination is re-performed for the print job for which the media mismatch determination has been performed once, the CPU 212 performs processing for notifying the user of an updated result of the media mismatch determination.

On the other hand, if the media mismatch determination button 704 has not been pressed (NO in step S1604), the processing proceeds to step S1605. In step S1605, the CPU 212 executes other processing. Then, the processing returns to step S1601, in which the CPU 212 enters a state waiting for an event due to the operation by the user.

Processing in step S1605 includes, for example, processing for shifting to a screen used to call up the details of a print job selected in the held job list 707 in response to pressing of the DETAIL/CHANGE button 707, but the description of the details thereof is omitted.

In the first exemplary embodiment, a print job selected in the held job list 707 is targeted for the media mismatch determination performed in response to pressing of the DETAIL/CHANGE button 707. However, this is not a restrictive one. All of the print jobs displayed in the held job list 707 may be targeted for the media mismatch determination.

Figure 17:
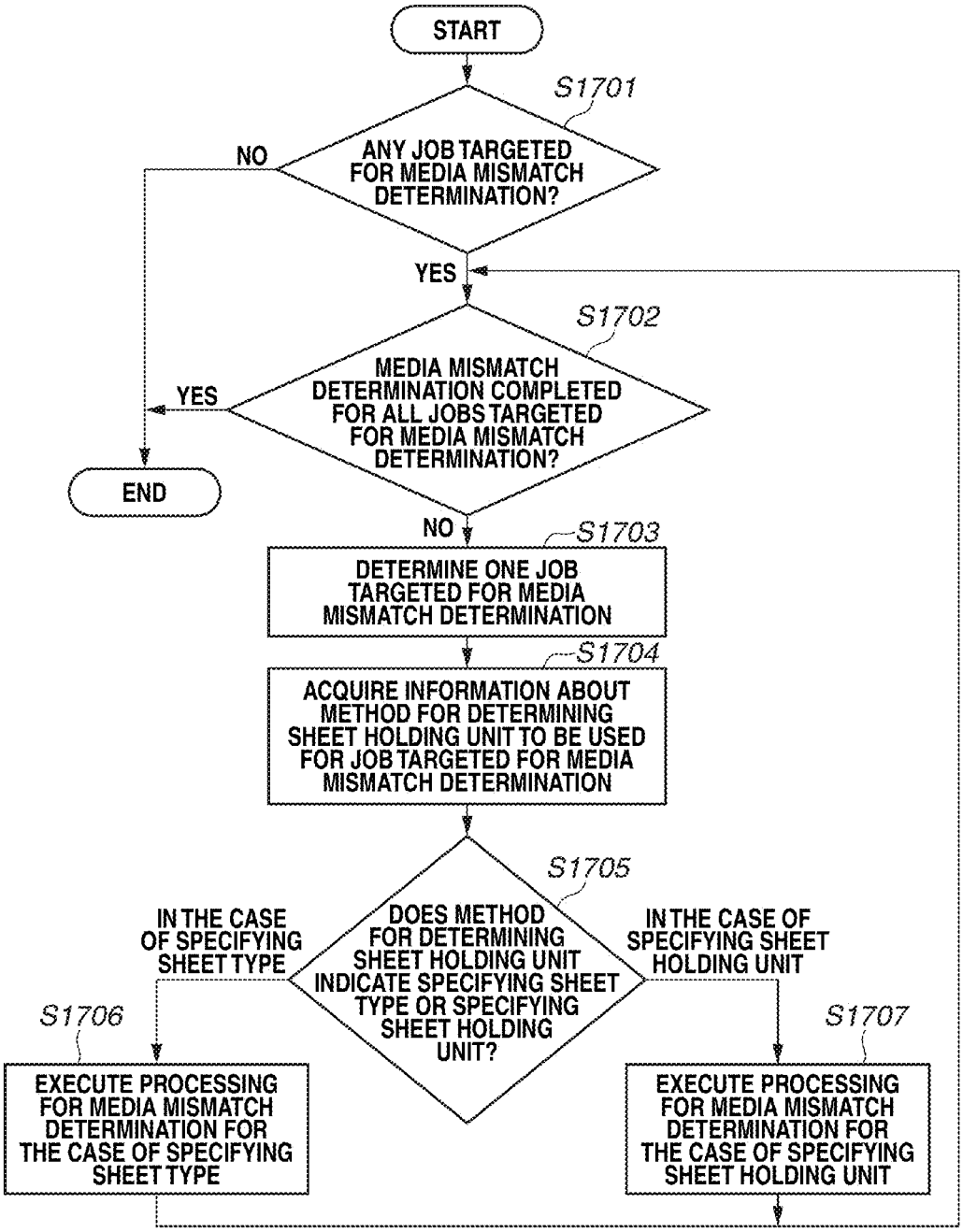
FIG. 17 is a flowchart illustrating processing for media mismatch determination (step S1607) illustrated in FIG. 16 in the digital printing machine according to the first exemplary embodiment.

FIG. 17 is a flowchart illustrating the details of the media mismatch determination processing in step S1607 according to the first exemplary embodiment. The media mismatch determination processing in step S1607 according to the first exemplary embodiment is performed in response to an instruction to display the held job list 702. The media mismatch determination processing is re-performed in response to pressing of the media mismatch determination button 704, and a result of the media mismatch determination is updated. This processing is implemented by the CPU 212 in the controller unit 205 executing the media mismatch determination function program 512, which is read from the ROM 207 or the HDD 209 and loaded onto the RAM 208.

In the following description according to the first exemplary embodiment, a print job displayed in the held job list 702 is targeted for the media mismatch determination. First, in step S1701, the CPU 212 determines whether the number of print jobs targeted for the media mismatch determination is one or more. If the number of print jobs targeted for the media mismatch determination is one or more (YES in step S1701), the processing proceeds to step S1702. On the other hand, if a result of the determination in step S1701 is false, i.e., if the number of print jobs targeted for the media mismatch determination is zero (NO in step S1701), the processing for the media mismatch determination illustrated in FIG. 17 ends. In step S1702, the CPU 212 determines whether the media mismatch determination has been completed for all of the jobs targeted for the media mismatch determination. If the media mismatch determination has not yet been completed for all of the jobs targeted for the media mismatch determination (NO in step S1702), the processing proceeds to step S1703. On the other hand, if a result of the determination in step S1702 is true, i.e., if the media mismatch determination has been completed for all of the jobs targeted for the media mismatch determination (YES in step S1702), the processing for the media mismatch determination illustrated in FIG. 17 ends. In step S1703, the CPU 212 determines one print job targeted for the media mismatch determination, and the processing proceeds to step S1704. In step S1704, the CPU 212 acquires information indicating whether the method for determining a sheet holding unit to be used for the print job determined in step S1703 to be targeted for the media mismatch determination is to specify a sheet type or to specify a sheet holding unit. In step S1705, the CPU 212 determines whether the method for determining a sheet holding unit to be used for the print job is to specify a sheet type or to specify a sheet holding unit. In the case of a print job specifying a sheet type, the CPU 212 instructs the sheet management unit 211 to refer to a sheet management table such as that illustrated in FIG. 8 and determines whether, with respect to a print job using A3 colored paper (red), A3 colored paper (red) is registered with any sheet holding unit. Then, when the CPU 212 determines that the size of sheets held in the sheet holding unit ID=2 is A4 and the media type thereof is colored paper (red), the CPU 212 determines the sheet holding unit ID=2 as a sheet holding unit to be used for the print job.

On the other hand, with respect to a print job specifying a sheet holding unit, if the print job specifies the sheet holding unit ID=3 in the sheet management table illustrated in FIG. 8, the CPU 212 determines "A3 plain paper 1" held in the sheet holding unit ID=3 as a sheet to be used for the print job.

If the CPU 212 determines that the print job is a print job specifying a sheet type (IN THE CASE OF SPECIFYING SHEET TYPE in step S1705), the processing proceeds to step S1706. On the other hand, if the CPU 212 determines that the print job is a print job specifying a sheet holding unit (IN THE CASE OF SPECIFYING SHEET HOLDING UNIT in step S1705), the processing proceeds to step S1707. The details of processing in step S1706 and processing in step S1707 are described below with reference to FIGS. 18 and 19, respectively. When the processing in step S1706 or S1707 is completed, the processing returns to step S1702.

Figure 18:
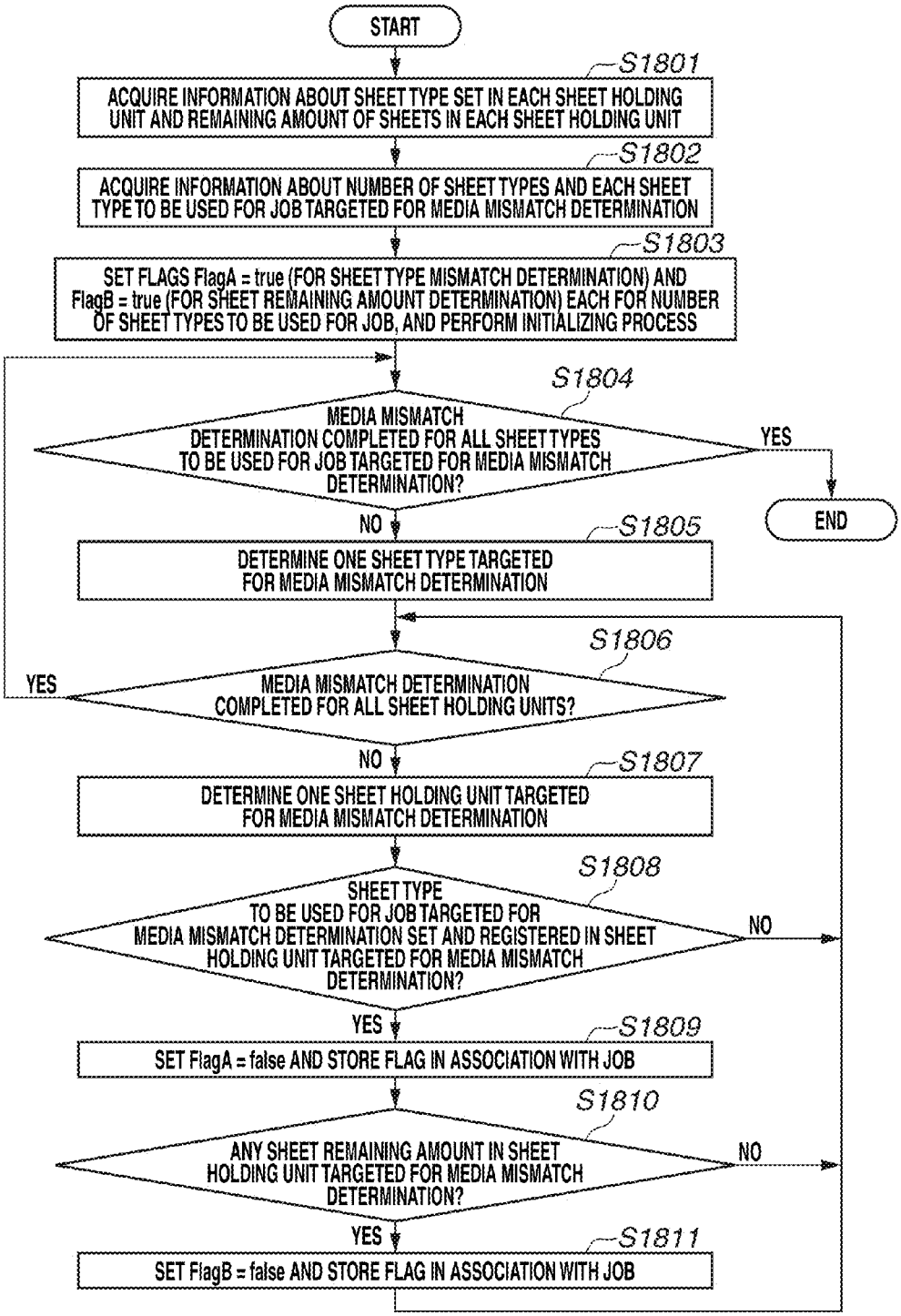
FIG. 18 is a flowchart illustrating processing for media mismatch determination in the case of a print job specifying a sheet type (step S1706), illustrated in FIG. 17, in the digital printing machine according to the first exemplary embodiment.

FIG. 18 is a flowchart illustrating processing for the media mismatch determination performed in a case where the print job targeted for the media mismatch determination is a print job specifying a sheet type. The processing is implemented by the CPU 212 in the controller unit 205 executing the media mismatch determination function program 512, which is read from the ROM 207 or the HDD 209 and loaded onto the RAM 208.

In step S1801, the CPU 212 acquires information about the sheet type and the remaining amount of sheets set in (registered with) each sheet holding unit included in the digital printing machine 102. The CPU 212 performs this processing in step S1801 by instructing the sheet management unit 211 to refer to a sheet management table stored in the HDD 209 such as that illustrated in FIG. 8. In step S1802, the CPU 212 retrieves print job data stored in the saved document storage region 513 with respect to the print job targeted for the media mismatch determination. Then, the CPU 212 acquires information about sheets to be used for the print job such as that illustrated in FIG. 9A, 9B, or 9C (the number of sheet types to be used for the print job and the sheet types). In step S1803, the CPU 212 sets two types of flags (FlagA and FlagB), which are used to retain a result of the media mismatch determination, each for the number of sheet types acquired in step S1802, and performs an initializing process. The flag FlagA is used to retain a result of determination as to whether attribute information of sheets to be used for the print job is not registered with any sheet holding unit, and is stored in the RAM 208. The flag FlagB is used to retain a result of determination as to whether there is no remaining amount of sheets to be used for the print job, and is stored in the RAM 208. The flag FlagA being true indicates a media mismatch (sheet type mismatch) state, i.e., indicates that the print job specifies a sheet type that is not registered with any sheet holding unit. On the other hand, the flag FlagB being true indicates a media mismatch (no remaining amount of sheets) state, i.e., indicates that the remaining amount of sheets of the sheet type to be used for the print job is zero.

In step S1804, the CPU 212 determines whether the media mismatch determination has been completed for all of the sheet types to be used for the print job targeted for the media mismatch determination. If the media mismatch determination has not yet been completed for all of the sheet types (NO in step S1804), the processing proceeds to step S1805. In step S1805, the CPU 212 determines one sheet type targeted for the media mismatch determination in the print job. In step S1806, the CPU 212 determines whether the media mismatch determination has been completed for all of the sheet holding units included in the digital printing machine 102. If a result of the determination in step S1806 is false, i.e., if there is a sheet holding unit for which the media mismatch determination has not yet been completed (NO in step S1806), the processing proceeds to step S1807. In step S1807, the CPU 212 determines a sheet holding unit targeted for the next media mismatch determination. In step S1808, the CPU 212 determines whether the sheet type targeted for the media mismatch determination in the print job determined in step S1805 matches the sheet type registered with the sheet holding unit targeted for the media mismatch determination determined in step S1807. If a result of the determination in step S1808 is false, i.e., if the two sheet types do not match each other (NO in step S1808), the processing returns to step S1806, in which the CPU 212 performs the media mismatch determination for the next sheet holding unit.

On the other hand, if a result of the determination in step S1808 is true, i.e., if the set and registered sheet type stored in the HDD 209 by the sheet management program 510 matches the sheet type registered with the sheet holding unit determined in step S1807 (YES in step S1808), the processing proceeds to step S1809. In step S1809, the CPU 212 sets the flag FlagA to a value "false" indicating that the print job specifies the sheet type that is registered with any sheet holding unit, and stores the flag FlagA in association with the print job. In step S1810, the CPU 212 determines whether there is a remaining amount of sheets in the sheet holding unit targeted for the media mismatch determination determined in step S1807. If the CPU 212 determines that there is a remaining amount of sheets (YES in step S1810), the processing proceeds to step S1811. In step S1811, the CPU 212 sets the flag FlagB to a value "false" indicating that there is a remaining amount of sheets of the sheet type to be used for the print job, and stores the flag FlagB in association with the print job. Then, the processing returns to step S1806, in which the CPU 212 performs the media mismatch determination for the next sheet holding unit. On the other hand, if a result of the determination in step S1810 is false, i.e., if there is no remaining amount of sheets (NO in step S1810), the processing returns to step S1806, in which the CPU 212 performs the media mismatch determination for the next sheet holding unit. If a result of the determination in step S1806 is true, i.e., if the CPU 212 determines that the media mismatch determination has been completed for all of the sheet holding units (YES in step S1806), the processing returns to step S1804, the CPU 212 performs the media mismatch determination for the next sheet type. If a result of the determination in step S1804 is true, i.e., if the CPU 212 determines that the media mismatch determination has been completed for all of the sheet types to be used for the print job targeted for the media mismatch determination (YES in step S1804), a series of processing operations for the media mismatch determination performed in the case of a print job specifying a sheet type ends. The details of processing for the media mismatch determination performed in the case of a print job specifying a sheet type in step S1706 illustrated in FIG. 17 have been described above.

Figure 19:
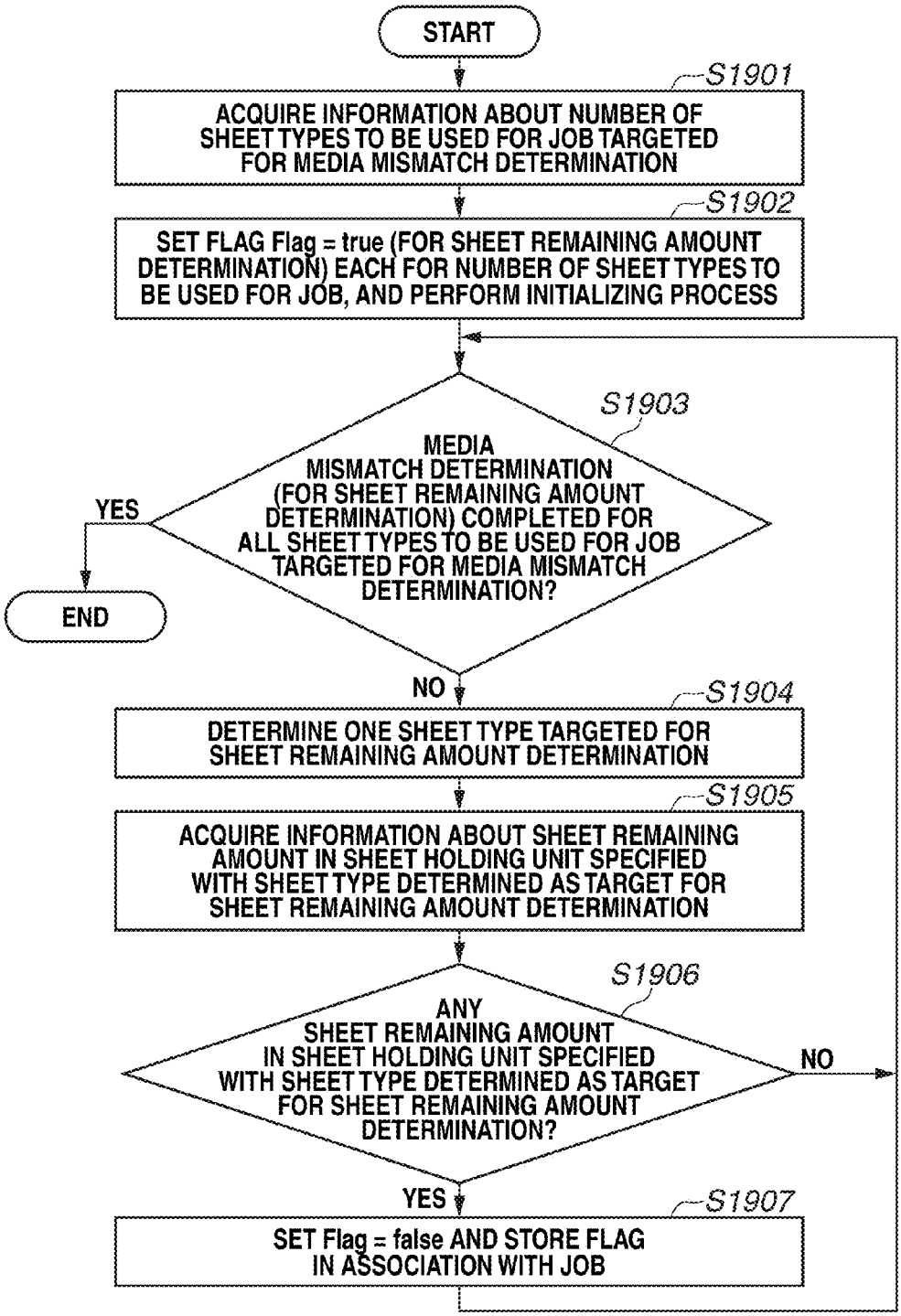
FIG. 19 is a flowchart illustrating processing for media mismatch determination in the case of a print job specifying a sheet holding unit (step S1707), illustrated in FIG. 17, in the digital printing machine according to the first exemplary embodiment.

On the other hand, if the CPU 212 determines that the print job is a print job specifying a sheet holding unit (IN THE CASE OF SPECIFYING SHEET HOLDING UNIT in step S1705), the processing proceeds to step S1707. FIG. 19 is a flowchart illustrating processing for the media mismatch determination performed in a case where the print job targeted for the media mismatch determination is a print job specifying a sheet holding unit. The processing is implemented by the CPU 212 in the controller unit 205 executing the media mismatch determination function program 512, which is read from the ROM 207 or the HDD 209 and loaded onto the RAM 208.

In step S1901, the CPU 212 acquires information about the number of sheet types to be used for the print job targeted for the media mismatch determination, as sheet information to be used for the print job such as that illustrated in FIG. 9A, 9B, or 9C. In step S1902, the CPU 212 sets a flag (Flag), which is used to retain a result of the media mismatch determination (remaining amount determination), each for the number of sheet types acquired in step S1901, and performs an initializing process. The flag Flag is used to retain a result of determination as to whether there is a remaining amount of sheets to be used for the print job, and is stored in the RAM 208. The flag Flag being true indicates a media mismatch state, i.e., indicates that the remaining amount of sheets of the sheet type to be used for the print job is zero.

In step S1903, the CPU 212 determines whether the media mismatch determination (sheet remaining amount determination) has been completed for all of the sheet types to be used for the print job targeted for the media mismatch determination (sheet remaining amount determination). If the media mismatch determination has not yet been completed for all of the sheet types (NO in step S1903), the processing proceeds to step S1904. In step S1904, the CPU 212 determines one sheet type targeted for the media mismatch determination (sheet remaining amount determination) in the print job. In step S1905, the CPU 212 acquires information about the remaining amount of sheets held in a sheet holding unit specified with the sheet type targeted for the sheet remaining amount determination determined in step S1904 among the sheet types to be used for the print job. The CPU 212 performs this processing in step S1905 by instructing the sheet management unit 211 to refer to a sheet management table such as that illustrated in FIG. 8. In step S1906, the CPU 212 determines whether there is a remaining amount of sheets in the sheet holding unit specified based on the information acquired in step S1905. If the CPU 212 determines that there is a remaining amount of sheets (YES in step S1906), the processing proceeds to step S1907. In step S1907, the CPU 212 sets the flag Flag to a value "false" indicating that there is a remaining amount of sheets of the sheet type to be used for the print job, and stores the flag Flag in association with the print job. Then, the processing returns to step S1903, in which the CPU 212 performs the media mismatch determination for the next sheet type.

If a result of the determination in step S1906 is false, i.e., if there is no remaining amount (NO in step S1906), the processing returns to step S1903, in which the CPU 212 also performs the media mismatch determination for the next sheet type.

If a result of the determination in step S1903 is true, i.e., if the media mismatch determination (sheet remaining amount determination) has been completed for all of the sheet types to be used for the print job targeted for the media mismatch determination (YES in step S1903), a series of processing operations for the media mismatch determination performed in the case of a print job specifying a sheet holding unit ends. The details of processing for the media mismatch determination performed in the case of a print job specifying a sheet holding unit in step S1707 illustrated in FIG. 17 have been described above.

Figure 20:
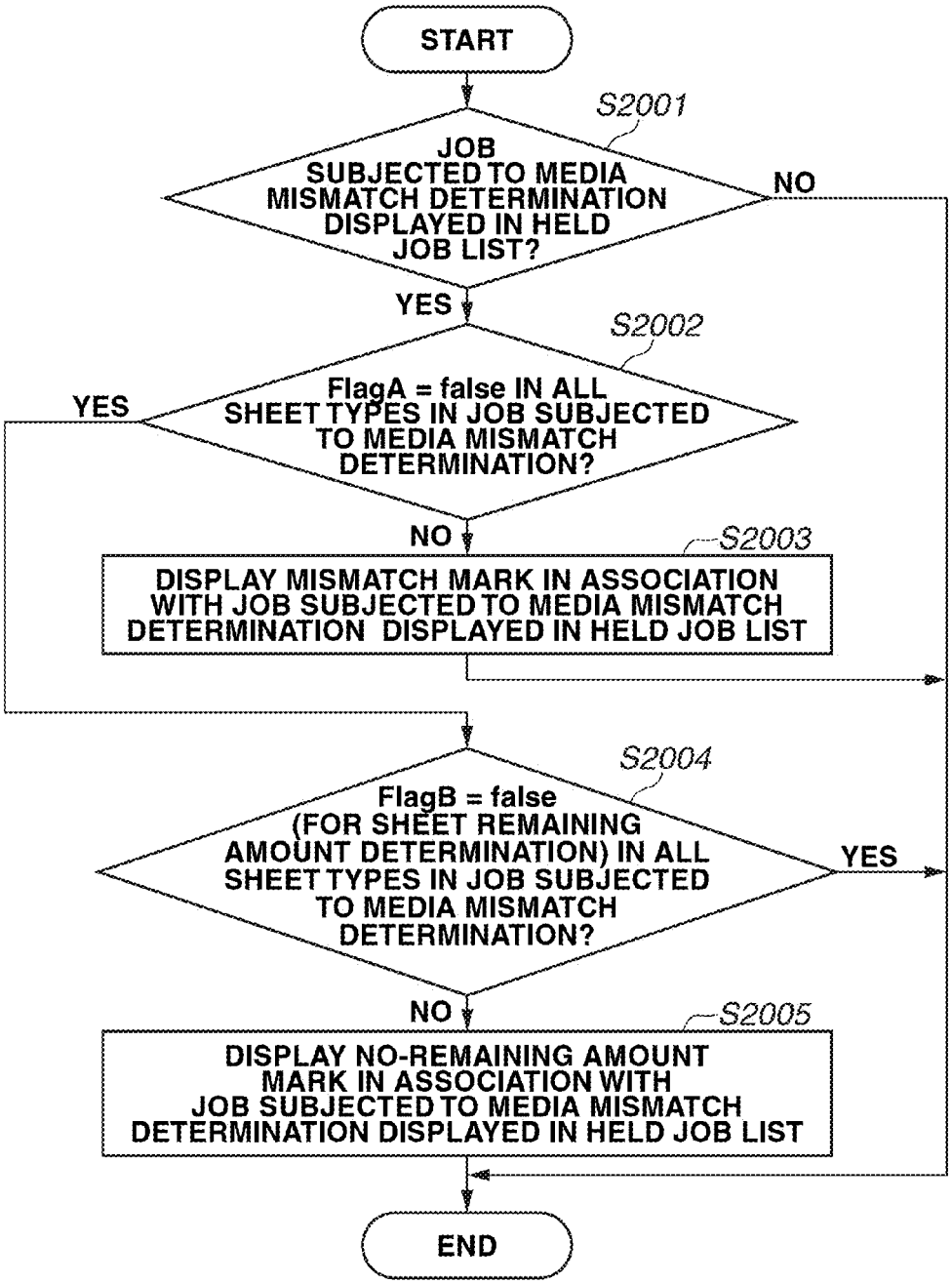
FIG. 20 is a flowchart illustrating processing for notification of a result of media mismatch determination (step S1608) illustrated in FIG. 16 in the digital printing machine according to the first exemplary embodiment.

FIG. 20 is a flowchart illustrating processing for notifying the held job list 702 of a result of the media mismatch determination. The processing is implemented by the CPU 212 in the controller unit 205 executing the UI function program 509, which is read from the ROM 207 or the HDD 209 and loaded onto the RAM 208.

In step S2001, the CPU 212 determines whether the print job subjected to the media mismatch determination is displayed in the held job list 702. If the CPU 212 determines that the print job subjected to the media mismatch determination is displayed in the held job list 702 (YES in step S2001), the processing proceeds to step S2002. In step S2002, the CPU 212 retrieves the value of the flag FlagA from the RAM 208 and determines whether the value of the flag FlagA is "false". The flag FlagA is used to retain a result of the sheet type mismatch determination to determine whether attribute information of sheets to be used for the print job subjected to the media mismatch determination is not registered with any sheet holding unit.

The result of the determination in step S2002 being false, i.e., a case where the value of the flag FlagA is true for at least one sheet type, indicates a media mismatch (sheet type mismatch) state, i.e., a state in which the print job specifies a sheet type that is not set in any sheet holding unit. Accordingly, in such a case (NO in step S2002), the processing proceeds to step S2003. In step S2003, the CPU 212 displays the mismatch mark 1102, which indicates the media mismatch state, at the entry of the print job in the held job list 702 in association with the print job, for example, as illustrated in FIG. 11. Then, a series of processing operations for notification of the result of the media mismatch determination ends.

On the other hand, if a result of the determination in step S2002 is true, i.e., if the value of the flag FlagA is "false" for all of the sheet types (YES in step S2002), the processing proceeds to step S2004. In step S2004, the CPU 212 retrieves the value of the flag FlagB from the RAM 208 and determines whether the value of the flag FlagB is "false". The flag FlagB is used to retain a result of the sheet remaining amount determination to determine whether there is no remaining amount of sheets to be used for the print job subjected to the media mismatch determination.

The result of the determination in step S2004 being false, i.e., a case where the value of the flag FlagB is "true" for at least one sheet type, indicates a media mismatch (sheet no-remaining amount) state, i.e., a state in which the remaining amount of sheets to be used for the print job is zero. Accordingly, in such a case (NO in step S2004), the processing proceeds to step S2005. In step S2005, the CPU 212 displays the no-remaining amount mark 1101, which indicates the media mismatch state, at the entry of the print job in the held job list 702 in association with the print job, for example, as illustrated in FIG. 11. Then, the CPU 212 notifies the held job list 702 of the result of the media mismatch determination, and a series of processing operations for notification of the result of the media mismatch determination ends. On the other hand, the result of the determination in step S2004 being true, i.e., a case where the value of the flag FlagB is "false" for all of the sheet types (YES in step S2004), indicates a state in which there is a remaining amount of sheets for all of the sheet types to be used for the print job. Accordingly, a series of processing operations for notification of the result of the media mismatch determination ends.

As described above, according to the first exemplary embodiment, the digital printing machine 102 performs the media mismatch determination on a print job displayed in the held job list 702, and notifies the user of a result of the media mismatch determination. Thus, in response to a print job being displayed and listed in the held job list 702, the digital printing machine 102 determines whether a sheet to be used for the print job is set in a sheet holding unit, prior to giving an instruction to start print processing, and notifies the user of a result of the determination. The digital printing machine 102 further determines whether the sheet to be used for the print job is present in the sheet holding unit, prior to giving an instruction to start print processing, and notifies the user of a result of the determination.

In the above-described first exemplary embodiment, a notification of a print job with a sheet type mismatch occurring, as a result of the media mismatch determination, is performed by displaying a mismatch mark in association with the print job. Further, a notification of a print job with sheet no-remaining amount occurring, as a result of the media mismatch determination, is performed by displaying a no-remaining amount mark in association with the print job. However, these notifications are not restrictive ones. The user only needs to check for any print job with a sheet type mismatch occurring or any print job with sheet no-remaining amount occurring, prior to giving an instruction to execute the print job, and, therefore, may be notified with another distinguishable mark, sound, or light.

In the above-described first exemplary embodiment, after giving an instruction to display print jobs in the held job list 702, the digital printing machine 102 performs the media mismatch determination on each of the displayed print jobs and notifies the user of a result of the media mismatch determination. Alternatively, according to a second exemplary embodiment, after a certain print job is selected from the held job list 702, the digital printing machine 102 can perform the media mismatch determination only on the selected print job and notify the user of a result of the media mismatch determination.

A digital printing system according to the second exemplary embodiment includes a digital printing machine 102 and a computer (PC) 101, which are interconnected via a network 100, similar to the configuration according to the first exemplary embodiment. The block diagram illustrating a functional configuration of the digital printing machine 102 according to the second exemplary embodiment and the block diagram illustrating a configuration of the computer 101 according to the second exemplary embodiment are similar to those in the first exemplary embodiment, and, therefore, the descriptions thereof are not repeated.

Figure 21:
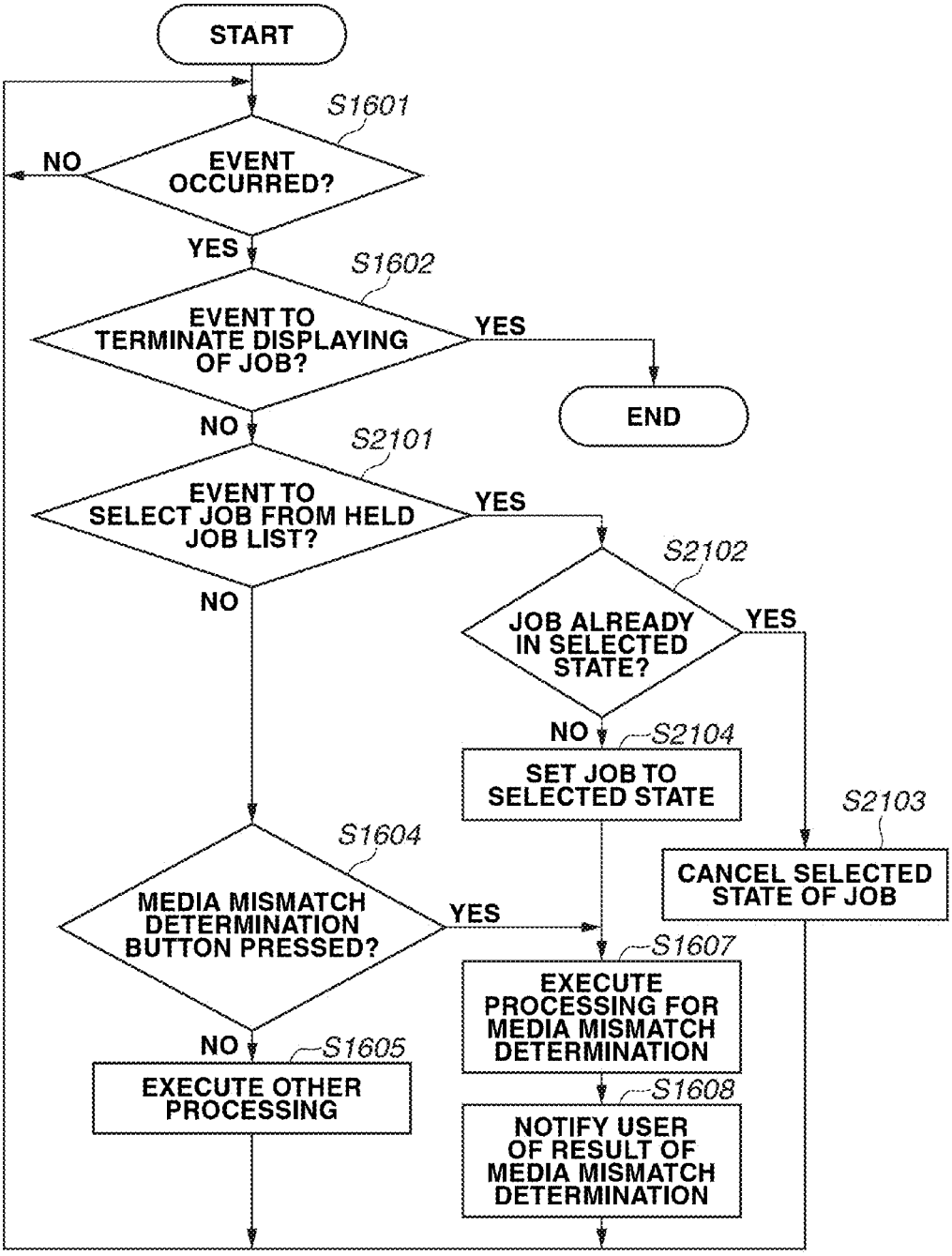
FIG. 21 is a flowchart illustrating processing performed by a digital printing machine according to a second exemplary embodiment of the present invention.

FIG. 21 is a flowchart illustrating processing performed by the digital printing machine 102 according to the second exemplary embodiment. The steps similar to those for performing the media mismatch determination according to the first exemplary embodiment are denoted with the same step numbers, and the descriptions thereof are not repeated. The processing is implemented by the CPU 212 in the controller unit 205 executing the media mismatch determination function program 512, which is read from the ROM 207 or the HDD 209 and loaded onto the RAM 208, and is started with the state in which the screen illustrated in FIG. 7 is displayed on the display unit of the operation unit 204.

After performing the above-described processing in steps S1601 and S1602, then in step S2101, the CPU 212 determines whether the user operation is an event to select a print job from among the print jobs displayed in the held job list 702. If the CPU 212 determines that the user operation is an event to select a print job from among the print jobs displayed in the held job list 702 (YES in step S2101), the processing proceeds to step S2102. In step S2102, the CPU 212 determines whether the print job is already in the selected state. If the CPU 212 determines that the print job is already in the selected state (YES in step S2102), the processing proceeds to step S2103. In step S2103, the CPU 212 cancels the selected state of the print job. Then, the processing returns to step S1601, in which the CPU 212 waits for an operation by the user. On the other hand, if the CPU 212 determines that the print job is not in the selected state (NO in step S2102), the processing proceeds to step S2104. In step S2104, the CPU 212 sets the print job to the selected state. More specifically, the CPU 212 displays a mark indicating the selected state (1001, 1002, or 1003) at the entry of the selected print job, as illustrated in FIG. 10. Then, in step S1607, the CPU 212 performs processing for the media mismatch determination according to the second exemplary embodiment and, in step S1608, the CPU 212 notifies the user of a result of the media mismatch determination according to the second exemplary embodiment. Then, the processing returns to step S1601, in which the CPU 212 waits for an operation by the user. If the CPU 212 determines that the user operation is other than the event to select a print job from among the print jobs displayed in the held job list 702 (NO in step S2101), the processing proceeds to step S1604. In step S1604, the CPU 212 determines whether the media mismatch determination button 704 has been pressed. Then, the CPU 212 proceeds with the subsequent processing described above. As described in the foregoing, according to the second exemplary embodiment, the CPU 212 targets a print job, selected from among the print jobs displayed in the held job list 701, for the media mismatch determination and notifies the user of a result of the media mismatch determination. More specifically, in response to a print job being selected from the held job list 702, the CPU 212, before giving an instruction to start print processing, determines whether a sheet to be used for the print job is set in any sheet holding unit and notifies the user of a result of the determination. Further, the CPU 212, before giving an instruction to start print processing, determines whether the sheet is present in the sheet holding unit and notifies the user of a result of the determination.

In the above-described first and second exemplary embodiments, an example of a case where only one of the mismatch mark 1102 and the no-remaining amount mark 1101 can be displayed at one print job entry, as illustrated in FIG. 11, has been described. However, a state in which, although a sheet is set in a sheet holding unit, the remaining amount of the sheet is zero (sheet no-remaining amount) and a state in which a sheet to be used for a print job is not set in any sheet holding unit may occur at the same time. For example, suppose that, in a case where a print job uses a plurality of types of sheets, the selected print job uses sheet A and sheet B.

Here, suppose that, although the sheet A is set in a sheet holding unit, the remaining amount thereof is zero, and the sheet B is not set in any sheet holding unit. In this case, the sheet A meets a condition for displaying the mismatch mark 1102 illustrated in FIG. 11, and the sheet B meets a condition for displaying the no-remaining amount mark 1101. However, in the case of the example illustrated in FIG. 11, the user cannot check whether there is no remaining amount of the sheet B in any sheet holding unit.

A digital printing system according to a third exemplary embodiment includes a digital printing machine 102 and a computer (PC) 101, which are interconnected via a network 100, similar to the configuration according to the first exemplary embodiment and the second exemplary embodiment. The block diagram illustrating a functional configuration of the digital printing machine 102 according to the third exemplary embodiment and the block diagram illustrating a configuration of the computer 101 according to the third exemplary embodiment are similar to those in the first exemplary embodiment and the second exemplary embodiment, and, therefore, the descriptions thereof are not repeated.

Figure 22:
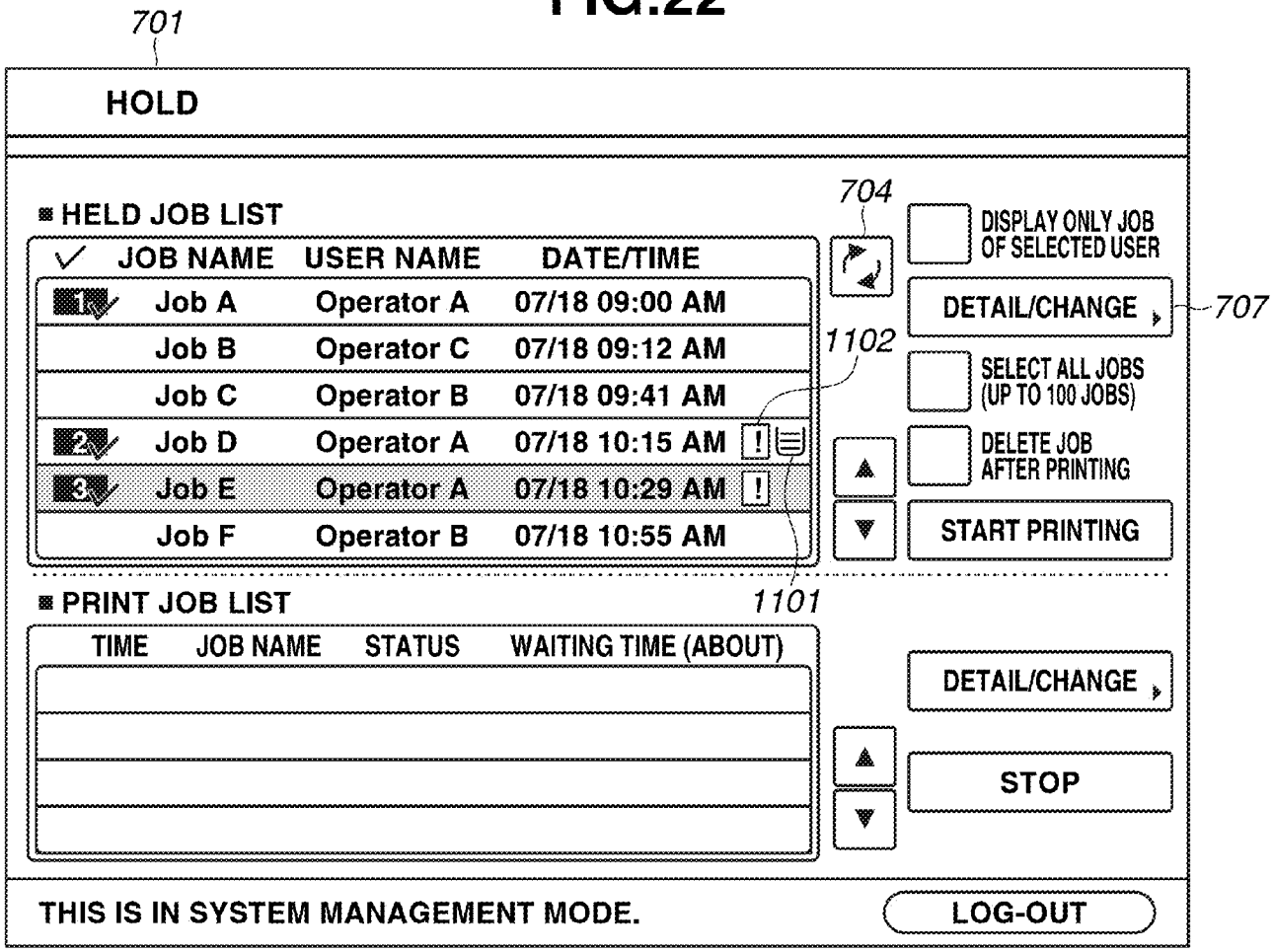
FIG. 22 illustrates an example of an operation screen for the job hold function displayed on the operation unit in a digital printing machine according to a third exemplary embodiment of the present invention.

FIG. 22 illustrates an example of an operation screen for the job hold function displayed on the operation unit 204 in the digital printing machine 102 according to the third exemplary embodiment. Portions similar to those described with reference to FIG. 7 are denoted with the same reference numerals. Referring to FIG. 22, operations performed and constituent elements of the screen displayed after the media mismatch determination is performed in response to print jobs being displayed or a print job being selected are similar to those in the first exemplary embodiment or the second exemplary embodiment, and, therefore, the descriptions thereof are not repeated.

As illustrated in FIG. 22, both the mismatch mark 1102 and the no-remaining amount mark 1101 are displayed at the entry of the job D. This display enables the user to recognize, with respect to a plurality of sheet types to be used for a print job, a state in which, although a sheet type is set in a sheet holding unit, the remaining amount of sheets of the sheet type is zero and a state in which a sheet type to be used for the print job is not set in any sheet holding unit.

Referring to FIG. 22, when the DETAIL/CHANGE button 707 is pressed under the condition in which, for example, the job D is selected, sheet sizes and media types to be used for the job D (for example, FIG. 9B) are displayed. Here, the digital printing machine 102 displays a sheet type the remaining amount of which is zero in a distinguishable manner and blinks the indication of a sheet holding unit in which the sheet type is set. Further, the digital printing machine 102 highlights the indication of a sheet type that is not set in any sheet holding unit. This notifies the user of a sheet type to be used for the job D the remaining amount of which is zero, a sheet holding unit in which that sheet type is set, and a sheet type that is not set in any sheet holding unit.

In the present exemplary embodiment, media information that is not set in any sheet holding unit is highlighted, and sheet information indicating no-remaining amount is blinked. However, these indications are not restrictive ones. The digital printing machine 102 may display the no-remaining amount mark 1101 and the mismatch mark 1102 in association with each sheet information.

Figure 23:
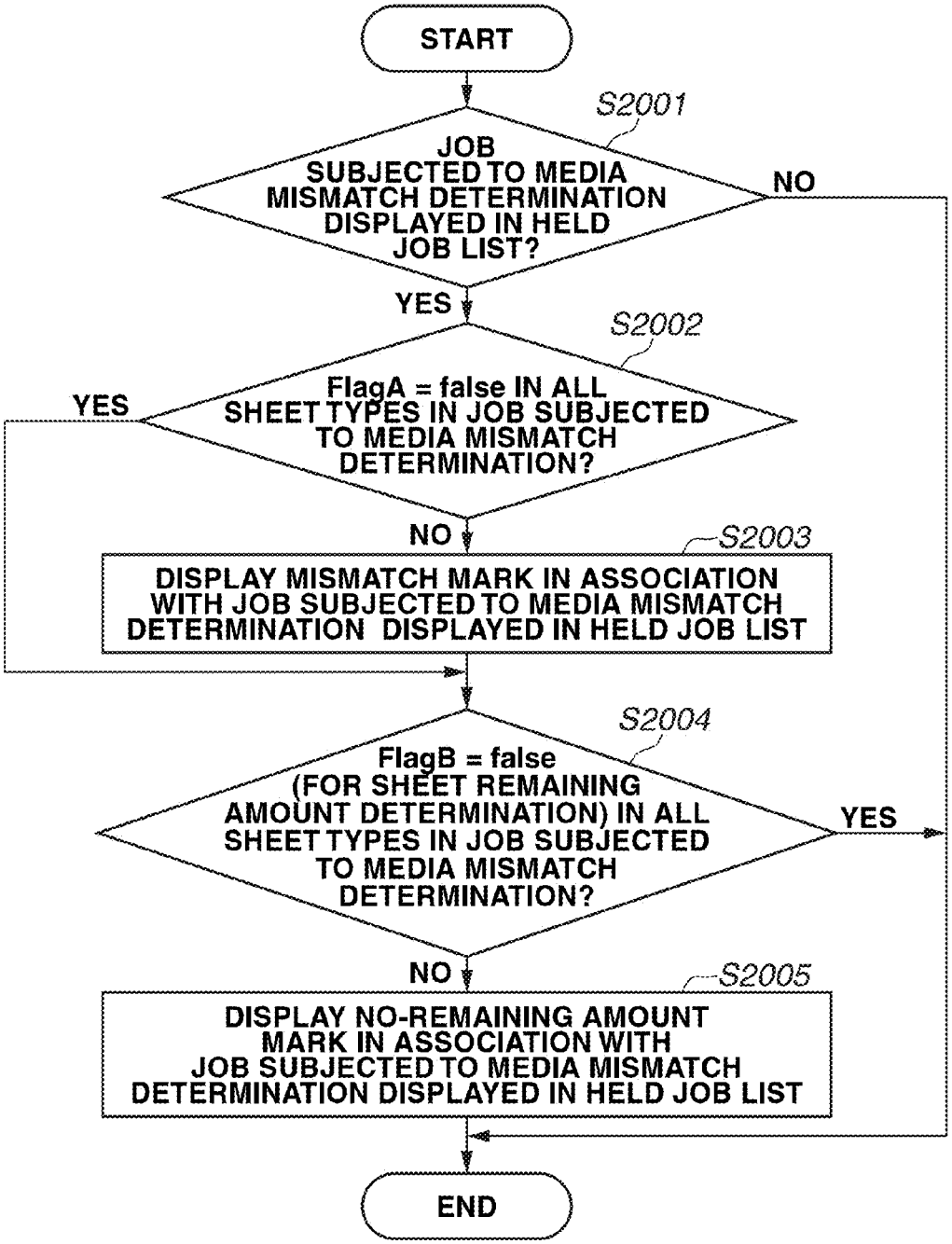
FIG. 23 is a flowchart illustrating processing for notification of a result of media mismatch determination (step S1608) illustrated in FIG. 16 in the digital printing machine according to the third exemplary embodiment.

FIG. 23 is a flowchart illustrating the details of processing for notification of a result of the media mismatch determination according to the third exemplary embodiment. The steps similar to those in FIG. 20, which is a flowchart illustrating processing for notification of a result of the media mismatch determination according to the first exemplary embodiment or the second exemplary embodiment, are denoted with the same step numbers. The processing is implemented by the CPU 212 in the controller unit 205 executing the UI function program 509, which is read from the ROM 207 or the HDD 209 and loaded onto the RAM 208.

A point of difference from FIG. 20 is as follows. In FIG. 20, the CPU 212 displays the mismatch mark 1102 in step S2003 and then ends the processing for notification of a result of the media mismatch determination. On the other hand, in FIG. 23, the CPU 212 executes step S2004 after step S2003, so that, after displaying the mismatch mark 1102, the CPU 212 can proceed to the processing for displaying the no-remaining amount mark 1101 if there is no remaining amount of sheets.

The process illustrated in FIG. 23 enables displaying the mismatch mark 1102 and the no-remaining amount mark 1101 together in a print job using a plurality of sheet types, as illustrated in FIG. 22. As described above, according to the third exemplary embodiment, the digital printing machine 102 can notify the user of both a state in which a sheet type to be used for a job is not set in any sheet holding unit and a state in which there is no remaining amount of a sheet to be used for the print job in any sheet holding unit. Therefore, convenience of users is enhanced.

In the processing for the media mismatch determination according to the above-described second exemplary embodiment, only a print job or jobs selected by the user in the held job list 702 are targeted for the media mismatch determination.

Furthermore, in the above-described first exemplary embodiment and second exemplary embodiment, updating of the result of the media mismatch determination responsive to pressing of the media mismatch determination button 704 is performed on only a print job or jobs selected by the user.

Here, suppose a case where, after the mismatch mark 1102 or the no-remaining amount mark 1101 is displayed for a print job as a result of the media mismatch determination, as illustrated in FIG. 11, the user performs an operation to deselect the print job. Then, such an exemplary embodiment can be considered that the mismatch mark 1102 or the no-remaining amount mark 1101 remains displayed even after the user has performed such an operation.

A digital printing system according to a fourth exemplary embodiment includes a digital printing machine 102 and a computer (PC) 101, which are interconnected via a network 100, similar to the configuration according to the first exemplary embodiment and the second exemplary embodiment. The block diagram illustrating a functional configuration of the digital printing machine 102 according to the fourth exemplary embodiment and the block diagram illustrating a configuration of the computer 101 according to the fourth exemplary embodiment are similar to those in the first exemplary embodiment and the second exemplary embodiment, and, therefore, the descriptions thereof are not repeated.

While the user can perform various work operations via the operation screen for the job hold function such as that illustrated in FIG. 7, it is greatly presumed that the user may perform various try-and-error operations during the work operations as a matter of course. For example, the user may deselect a print job that has been once selected, and then re-select the print job at later timing. In view of convenience of users during an operation, a print job, even in a non-selected state, that was once selected by the user and subjected to the media mismatch determination corresponds to a candidate for a print job that is re-selected at later timing. Considering such a situation, it is not advisable to cancel displaying of the mismatch mark 1102 or the no-remaining amount mark 1101 when a print job that is in the selected state is deselected. Rather, it may be desirable to maintain the displayed state of the mismatch mark 1102 or the no-remaining amount mark 1101.

Figure 24:
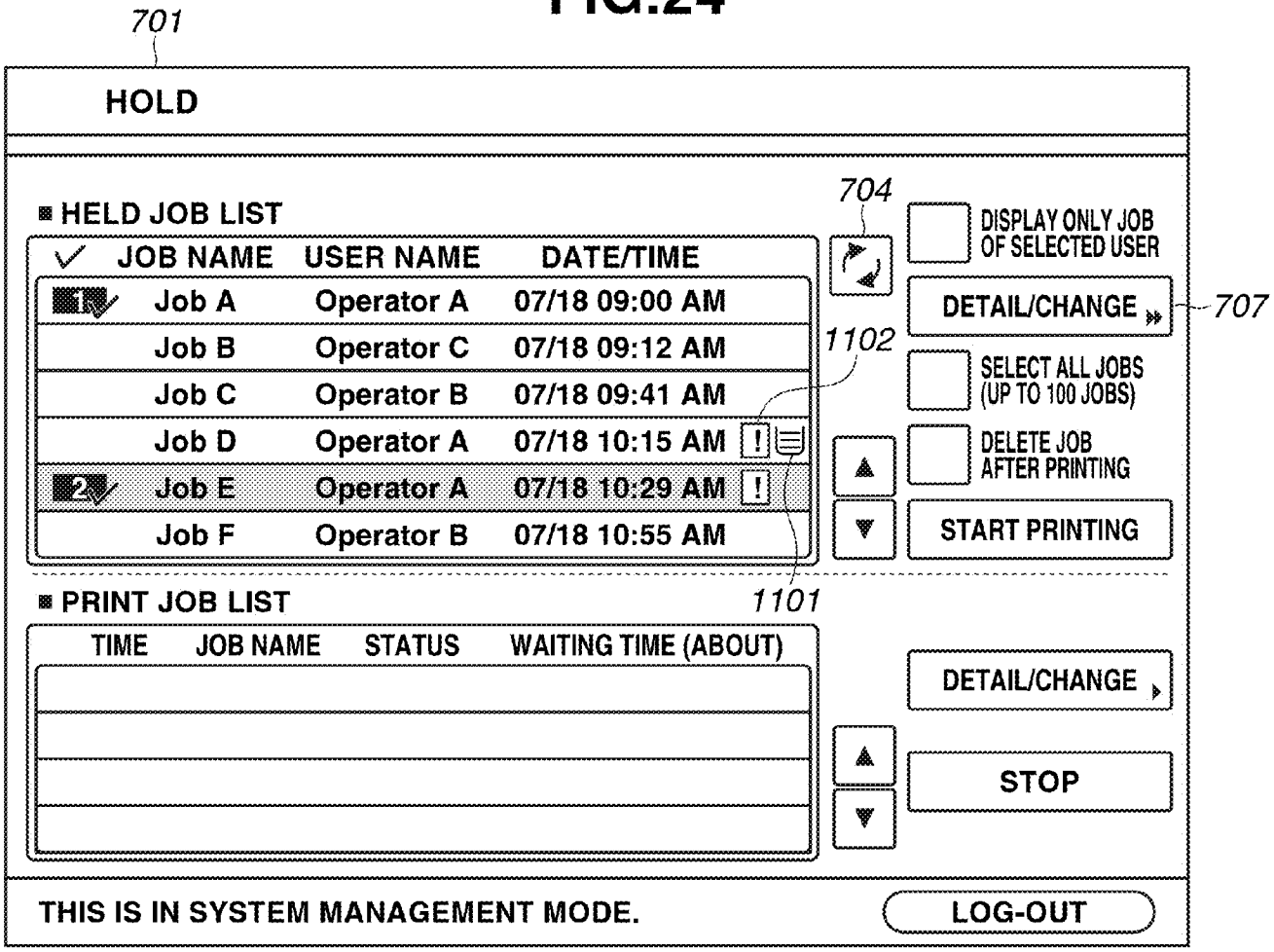
FIG. 24 illustrates an example of an operation screen for the job hold function displayed on the operation unit in a digital printing machine according to a forth exemplary embodiment of the present invention.

Thus, the fourth exemplary embodiment is arranged to maintain the displayed state of the mismatch mark 1102 or the no-remaining amount mark 1101, which indicates the result of the media mismatch determination, even when a print job (job D), which was once selected, is deselected, as illustrated in FIG. 24.

A digital printing system according to a fifth exemplary embodiment includes a digital printing machine 102 and a computer (PC) 101, which are interconnected via a network 100, similar to the configuration according to the first exemplary embodiment and the second exemplary embodiment. The block diagram illustrating a functional configuration of the digital printing machine 102 according to the fifth exemplary embodiment and the block diagram illustrating a configuration of the computer 101 according to the fifth exemplary embodiment are similar to those in the first exemplary embodiment and the second exemplary embodiment, and, therefore, the descriptions thereof are not repeated.

In each of the above-described exemplary embodiments, as a result of the media mismatch determination, the mismatch mark 1102 or the no-remaining amount mark 1101 is displayed for each of the print jobs displayed in the held job list 702, as illustrated in FIG. 11 and the equivalents figures. The displayed state of such a mark is maintained until the result of the media mismatch determination is updated in response to re-pressing of the media mismatch determination button 704. Such a displayed state can be stored in a nonvolatile memory together with data and print settings of a print job stored in the saved document storage region 513, so that a further advantageous effect can be obtained. Thus, the result of the media mismatch determination can be stored in a permanent manner. Accordingly, for example, even when the digital printing machine 102 is powered off and then powered on again, the result of the media mismatch determination performed before the digital printing machine 102 is powered off can be retained until the digital printing machine 102 is powered on again. This enables the result of the media mismatch determination performed before the digital printing machine 102 is powered off to be displayed in the held job list 702 when the digital printing machine 102 is powered on without the media mismatch determination button 704 being re-pressed.

Thus, for example, even when the user powers off the digital printing machine 102 to interrupt an operation in the process of a work and then powers on the digital printing machine 102 to resume the work, the user can readily confirm the continuity of the work.

The present invention is not limited to the above-described exemplary embodiments, and can be embodied in various modified manners (including an organic combination of the exemplary embodiments). Such modifications should not be construed to be excluded from the scope of the present invention.

For example, in the above-described exemplary embodiments, "sheet no-remaining amount" in a determination as to whether there is no remaining amount of sheets to be used for a print job represents a state in which it is detected by a sensor that the remaining amount of sheets held in a sheet holding unit is zero. However, this is not a restrictive one. For example, a state in which the number of sheets held in a sheet holding unit has become less than a predetermined number, even if the number of sheets held in the sheet holding unit has not become zero, may be regarded as "sheet no-remaining amount".

Furthermore, for example, in the above-described exemplary embodiments, the CPU 212 of the controller unit 205 included in the digital printing machine 102 comprehensively performs the above-described various control operations. However, a printing control apparatus, such as an external controller, which is separated from the digital printing machine 102, may perform a part or the whole of the above-described various control operations.

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-122459 filed Jun. 11, 2013, which is hereby incorporated by reference herein in its entirety.

What is claimed is:

1. A control apparatus comprising:

a display unit configured to display a job that uses a first sheet and a second sheet, according to a display instruction;

a storing unit configured to store attribute information of sheets to be held in sheet holding units;

a first determination unit configured to determine, in response to the display instruction, whether attribute information of the first sheet is stored in the storing unit and whether attribute information of the second sheet is stored in the storing unit;

a second determination unit configured to determine, in response to the display instruction, whether a sheet is held in a sheet holding unit for which the attribute information of the first sheet is stored in the storing unit and whether a sheet is held in the sheet holding unit for which the attribute information of the second sheet is stored in the storing unit; and a notification unit configured to perform, in a case where the first determination unit determines that the attribute information of the first sheet is not stored in the storing unit and the second determination unit determines that no sheets are held in the sheet holding unit for which the attribute information of the second sheet is stored in the storing unit, a notification indicating that the attribute information of the first sheet is not stored in the storing unit and no sheets are held in the sheet holding unit for which the attribute information of the second sheet is stored in the storing unit, in response to the display instruction.

2. The control apparatus according to claim 1, wherein the second determination unit does not determine whether a sheet is held in the respective sheet holding units in a case where the first determination unit determines that the respective pieces of attribute information are not stored in the storing unit.

3. The control apparatus according to claim 1, further comprising a selection unit configured to select a job displayed by the display unit, wherein the notification unit performs the notification before the control apparatus receives an instruction to execute the job selected by the selection unit.

4. The control apparatus according to claim 1, wherein the notification unit performs the notification with a mark in association with the job.

5. The control apparatus according to claim 1, wherein the notification unit performs the notification indicating that the attribute information of the first sheet is not stored in the storing unit and no sheets are held in the sheet holding unit for which the attribute information of the second sheet is stored in the storing unit, with respective differently-shaped marks in association with the job.

6. The control apparatus according to claim 1, wherein the notification unit further performs a notification indicating the attribute information of the first sheet and the attribute information of the second sheet in association with the job.

7. The control apparatus according to claim 1, wherein the notification unit further performs a notification indicating the sheet holding unit for which the attribute information of the second sheet is stored in the storing unit, in association with the job.

8. The control apparatus according to claim 1, further comprising:

a selection unit configured to select a job displayed by the display unit; and a receiving unit configured to receive an instruction to execute the job selected by the selection unit, wherein the receiving unit does not receive the instruction to execute the job in a case where the first determination unit determines that the attribute information of the first sheet is not stored in the storing unit.

9. The control apparatus according to claim 1, further comprising:

a selection unit configured to select a job displayed by the display unit; and a receiving unit configured to receive an instruction to execute the job selected by the selection unit, wherein the receiving unit does not receive the instruction to execute the job in a case where the second determination unit determines that no sheets are held in the sheet holding unit for which the attribute information of the second sheet is stored in the storing unit.

10. The control apparatus according to claim 1, further comprising an instruction unit configured to perform an instruction to the first determination unit or the second determination unit to further perform the determination.

11. The control apparatus according to claim 1, wherein the attribute information includes at least one of sheet size, sheet grammage, sheet surface property, sheet shape, and sheet color.

12. A control apparatus comprising:

a display unit configured to display a job that uses a first sheet and a second sheet;

a selection unit configured to select a job displayed by the display unit;

a storing unit configured to store attribute information of sheets to be held in sheet holding units;

a first determination unit configured to determine, in response to selection of the job by the selection unit, whether attribute information of the first sheet is stored in the storing unit and whether attribute information of the second sheet is stored in the storing unit;

a second determination unit configured to determine, in response to selection of the job by the selection unit, whether a sheet is held in a sheet holding unit for which the attribute information of the first sheet is stored in the storing unit and whether a sheet is held in the sheet holding unit for which the attribute information of the second sheet is stored in the storing unit; and a notification unit configured to perform, in a case where the first determination unit determines that the attribute information of the first sheet is not stored in the storing unit and the second determination unit determines that no sheets are held in the sheet holding unit for which the attribute information of the second sheet is stored in the storing unit, a notification indicating that the attribute information of the first sheet is not stored in the storing unit and no sheets are held in the sheet holding unit for which the attribute information of the second sheet is stored in the storing unit, in response to selection of the job by the selection unit.

13. A computer-readable storage medium storing a computer program for controlling a control apparatus, the computer program comprising:

a code to display, on a display unit, a job that uses a first sheet and a second sheet;

a code to select a job displayed on the display unit;

a code to store, in a storing unit, attribute information of sheets to be held in sheet holding units;

a code to determine, in response to selection of the job, whether attribute information of the first sheet is stored in the storing unit and whether attribute information of the second sheet is stored in the storing unit;

a code to determine, in response to selection of the job, whether a sheet is held in a sheet holding unit for which the attribute information of the first sheet is stored in the storing unit and whether a sheet is held in the sheet holding unit for which the attribute information of the second sheet is stored in the storing unit; and a code to perform, in a case where it is determined that the attribute information of the first sheet is not stored in the storing unit and it is determined that no sheets are held in the sheet holding unit for which the attribute information of the second sheet is stored in the storing unit, a notification indicating that the attribute information of the first sheet is not stored in the storing unit and no sheets are held in the sheet holding unit for which the attribute information of the second sheet is stored in the storing unit, in response to selection of the job.

* * * * *